US008121499B2

(12) United States Patent
Fujiwara

(10) Patent No.: US 8,121,499 B2
(45) Date of Patent: Feb. 21, 2012

(54) IMAGE FORMING APPARATUS

(75) Inventor: Motohiro Fujiwara, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 111 days.

(21) Appl. No.: 12/765,311

(22) Filed: Apr. 22, 2010

(65) Prior Publication Data

US 2010/0272453 A1 Oct. 28, 2010

(30) Foreign Application Priority Data

Apr. 23, 2009 (JP) ..... 2009-104720
Jan. 6, 2010 (JP) ..... 2010-001198

(51) Int. Cl.
*G03G 15/08* (2006.01)

(52) U.S. Cl. ..... 399/27

(58) Field of Classification Search ..... 399/27, 399/30, 49, 53, 58, 60, 62, 222; 358/448, 358/461

See application file for complete search history.

(56) References Cited

U.S. PATENT DOCUMENTS 6,853,817 B2 * 2/2005 Suzuki ..... 399/49
7,050,729 B2 5/2006 Fujiwara
7,113,712 B2 * 9/2006 Gomi ..... 399/48
7,580,647 B2 * 8/2009 Komiya ..... 399/49

FOREIGN PATENT DOCUMENTS

JP 5-257352 A 10/1993
JP 10-39608 A 2/1998
JP 2001-154427 A 6/2001
JP 2002-162795 A 6/2002
JP 2003-57891 A 2/2003
JP 2007-78896 A 3/2007

* cited by examiner

*Primary Examiner* — Kiho Kim

(74) *Attorney, Agent, or Firm* — Fitzpatrick, Cella, Harper & Scinto

(57) ABSTRACT

An image forming apparatus corrects a development contrast for normal image formation so as to satisfy the following relationships:

$$VcontG2 = VcontG1 \times VcontP2 / VcontP1 \times \alpha, \text{ and}$$

$$0.9 \leqq \alpha \leqq 1.1,$$

where VcontP1 is a development contrast for a patch image formation before a correction by a first correcting device;

VcontP2 is a development contrast for the patch image formation after the correction by the first correcting device;

VcontG1 is a development contrast for normal image formation before a correction by a second correcting device; and VcontG2 is a development contrast for normal image formation after the correction by the second correcting device.

5 Claims, 15 Drawing Sheets

COMP.EX (a) MAX. DENSITY (b) DEV. CNTRST (c) TNR CONTENT

EMB.1

(a) MAX. DENSITY (b) DEV. CNTRST (c) TNR CONTENT

IMAGE FORMING APPARATUS

FIELD OF THE INVENTION AND RELATED ART

The present invention relates to an image forming apparatus designed so that toner is supplied to its developing apparatus based on the results of the detection of an image of a test patch. More specifically, it relates to an operational control for correcting the development contrast for the formation of an ordinary image as it is detected that the toner density of developer is outside a preset range.

An image forming apparatus which forms an electrostatic image on its image bearing member, and develops the electrostatic latent image by causing its developer bearing member to bear the so-called two-component developer, that is, developer made up of toner and carrier, is widely in use. In a developing apparatus which uses two-component developer, only toner is consumed as images are formed. Thus, as images are formed by an image forming apparatus which employs a developing apparatus which uses, the two-component toner in the developing apparatus reduces in toner density, and therefore, the developing apparatus is automatically replenished with the toner from a toner supplying apparatus as the toner is consumed (ATR: automatic toner replenishment).

As for the method for controlling the amount by which a developing apparatus is replenished with toner, various methods have been put to practical use. One of these methods is referred to as a "patch detection ATR". According to this method, an image of a test patch is formed on an image bearing member under a preset exposure condition and a preset development condition. Then, the amount of light reflected by the test patch image is measured. Then, the amount by which a developing apparatus is replenished with toner is controlled so that the density of the test patch image will remain at a preset level. More specifically, if the test patch image is insufficient in density, it means that toner is excessive in the amount of charge relative to the amount of development contrast. Thus, the amount by which toner is supplied to the developing apparatus is increased to increase the two-component developer in toner ratio in order to decrease the toner particles in the developing apparatus in the opportunity for friction to occur between the toner particles and carrier particles, so that the toner is reduced in the amount of charge it receives. On the other hand, if the test patch image is excessive in density, it means that the toner is insufficient in the amount of charge relative to the amount of developer contrast. Thus, the amount by which toner is supplied to the developing apparatus is decreased to decrease the two-component developer in toner ratio in order to increase the toner particles in the developing apparatus in the opportunity for friction to occur between the toner particles and carrier particles, so that the toner is increased in the amount of charge it receives.

However, the toner ratio of the two-component developer in a developing apparatus is not the only factor that affects the amount by which the toner in the developing apparatus is charged. That is, it is affected also by absolute humidity, chargeability of the toner (supplied toner), operational condition of a developing apparatus, etc. Thus, if a developing apparatus is unconditionally replenished with toner based on only the results of the aforementioned measurement of the density of the test patch image, the toner ratio, that is, the toner density, of the two-component developer in the developing apparatus may sometimes fall outside the proper range (for example, 5-10% in weight ratio). If the toner density falls below the bottom limit of the proper range, it sometimes occurs that the amount, by which the portions of an electrostatic image, which correspond to the high density portions of an image is to be supplied with toner, becomes insufficient, and therefore, images of lower quality are formed. On the other hand, if the toner density exceeds the top limit of the proper range, it sometimes occurs that toner transfers onto even the portions of an electrostatic image, which correspond to the white portions of an image, and therefore, images of lower quality are formed.

Therefore, the following method is employed as one of the methods for preventing the formation of low quality images. That is, a developing apparatus is provided with a permeability sensor and/or a reflectivity sensor so that the toner density of the two-component developer in a developing apparatus is independently detected, and if the toner density reaches the top limit of the proper range, the toner supply to the developing apparatus is stopped even if the test patch image is insufficient in density, whereas if the toner density reaches the bottom limit of the proper range, the developing apparatus is forcefully replenished with the toner from a toner supplying apparatus even if the test patch image is excessive in image density (Japanese Laid-open Patent Application H10-039608: Patent Document 1).

Patent Document 1 discloses an ATR method which predictively controls a toner replenishment operation by counting exposure dots of areal gradation. It also discloses an ATR method which retroactively controls a toner replenishment operation by detecting the density of a test patch image on a photosensitive drum with the use of a density sensor. In the case of the second method, the toner density of the two-component developer in a developing apparatus is detected with the use of a density sensor which detects the light reflected by the two-component developer, and if the amount of the output of the density sensor is outside a preset range, the developing apparatus is forcefully replenished with toner, or forcefully stopped from being replenished with toner, regardless of the amount of the output of the image density sensor.

However, in the case where the control disclosed in Patent Document 1 is carried out, an image forming apparatus is prevented from controlling toner in the amount of charge. Therefore, the image forming apparatus fails to be stable in the density (amount by which toner is adhered to electrostatic image on photosensitive drum) of an image of the test patch, and also, in the density of an image of an ordinary pattern (ordinary image), even when the apparatus is kept the same in development contrast. That is, the amount by which toner is adhered to an electrostatic image on a photosensitive drum falls outside the normal range, which naturally makes it virtually impossible for the apparatus to remain consistent in image density and tone (or toner of color).

Japanese Laid-open Patent Application 2007-78896 (Patent Document 2) discloses another method for controlling the toner replenishment operation. This method feeds back the results of the detection of the density of a test patch image to the development contrast as the two-component developer in the apparatus reaches its limit in terms of toner density. In the case of this method, an image forming apparatus is changed in development contrast by adjusting the apparatus in exposure output, charge voltage, or development voltage. Thus, it is ensured that even if toner becomes abnormal in the amount of charge, the toner is adhered to the electrostatic image of the test patch by an amount which is within the normal range.

It was discovered that if an image forming apparatus is controlled by the method disclosed in Patent Document 2 when the development contrast for the formation of an image of the test patch is different from the development contrast for the formation of an ordinary image, the image forming apparatus becomes unsatisfactory in terms of the reproducibility of the highest level of density.

For example, if the image forming apparatus is adjusted in its exposure output in order to ensure that a proper amount of toner is adhered to the electrostatic image of the test patch on the photosensitive drum when the exposure output for the formation of the image of the test patch is lower than the exposure output for the formation of an ordinary image, the image forming apparatus tends to become lower in the highest level of image density.

Further, in the case where the amount by which toner was adhered to the electrostatic image of the test patch on the photosensitive drum, is determined by detecting the amount of light reflected by the toner having adhered to the electrostatic image, if an image of the test patch is formed at the highest level of areal gradation, the amount of the toner having adhered to the electrostatic image is likely to be less accurately detected. Further, the toner having adhered to the electrostatic image of the test patch on the photosensitive drum is not transferred onto recording medium, adding to the work load for removing the toner from the peripheral surface of the photosensitive drum. In this case, therefore, when forming an image of the test patch, the image forming apparatus is reduced in areal gradation level to make it possible for the amount of the toner having adhered to the electrostatic latent image of the test patch to be more accurately detected, and also to reduce the amount by which the work load is increased by the control operation. Also, in this case, however, the amount by which the image forming apparatus is adjusted in the development contrast using the test patch image which is lower in areal gradation level, tends to cause the image forming apparatus to become insufficient in density, in terms of areal gradation.

SUMMARY OF THE INVENTION

Thus, the primary object of the present invention is to provide an image forming apparatus which can be adjusted in the development contrast for the formation of an ordinary image even if the apparatus cannot be controlled in the amount of toner charge because the toner density of the two-component developer in the apparatus fell outside a preset range, and which therefore can form images which are normal in the highest level of density even if the apparatus cannot be controlled in the amount of toner charge because the toner density of the two-component developer in the apparatus fell outside a preset range.

According to an aspect of the present invention, there is provided an image forming apparatus comprising an image bearing member; a developing device for developing an electrostatic image formed on said image bearing member with a developer carried on a developer carrying member, the developer including toner and a carrier; a supplying device for supplying the toner to said developing device; an image forming portion capable of forming an image with a development contrast which is a potential difference between a DC bias applied to said developer carrying member and an image portion potential of said image bearing member and capable of forming a patch image with the development contrast which is smaller than the development contrast for a normal image formation; an image density sensor for detecting an image density of the patch image; a first controller corrected an amount of supply by said supplying device so as to provide a reference density detected by said image density sensor; a density sensor for detecting a toner content of the developer accommodated in said developing device; a second controller for limiting the amount of the supply by said supplying device or forcing the supply irrespective of an output of said image density sensor, when the output of said density sensor is outside a predetermined range; a first correcting device for correcting the development contrast when the patch image is formed when the output of said density sensor is outside the predetermined range; a second correcting device for correcting a development contrast for the normal image formation in accordance with the amount of correction, by said first correcting device, of the development contrast in the patch image formation; wherein said second correcting device corrects the development contrast for the normal image formation so as to satisfy:

$$VcontG2 = VcontG1 \times VcontP2 / VcontP1 \times \alpha$$

$$0.9 \leqq \alpha \leqq 1.1,$$

where

VcontP1: the development contrast for the patch image formation before the correction by said first correcting device, VcontP2: the development contrast for the patch image formation after the correction by said first correcting device, VcontG1: the development contrast for the normal image formation before the correction by said second correcting device.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to appended drawing. In terms of the characteristic that as toner density reaches the limit of its proper range, an image forming apparatus is adjusted in development contrast instead of toner density, the present invention is also applicable to image forming apparatuses which are partially or entirely different in structure from the image forming apparatuses in the preferred embodiments of the present invention.

In other words, the present invention is applicable to any image forming apparatus as long as the image forming apparatus uses two-component developer to form an image. That is, the present invention is applicable to any image forming apparatus regardless of whether the apparatus is of the tandem/single drum type, intermediary transfer type, or direct transfer type. In the following description of the preferred embodiments of the present invention, only the portions of the image forming apparatus, which are essential to the formation and transfer of toner images, will be described. However, the present invention is also applicable to various image forming apparatuses, such as a printer, various printing machines, copying machines, a facsimile apparatuses, multifunction image forming apparatuses, etc., made of devices, equipment, and shells (external structures) necessary for the completion of image forming apparatuses, in addition to the portions which will be described next.

The general components, items, etc., in the image forming apparatuses disclosed in Patent Documents 1 and 2 will not be illustrated, and also, will not be described.

<Image Forming Apparatus>

Figure 1:
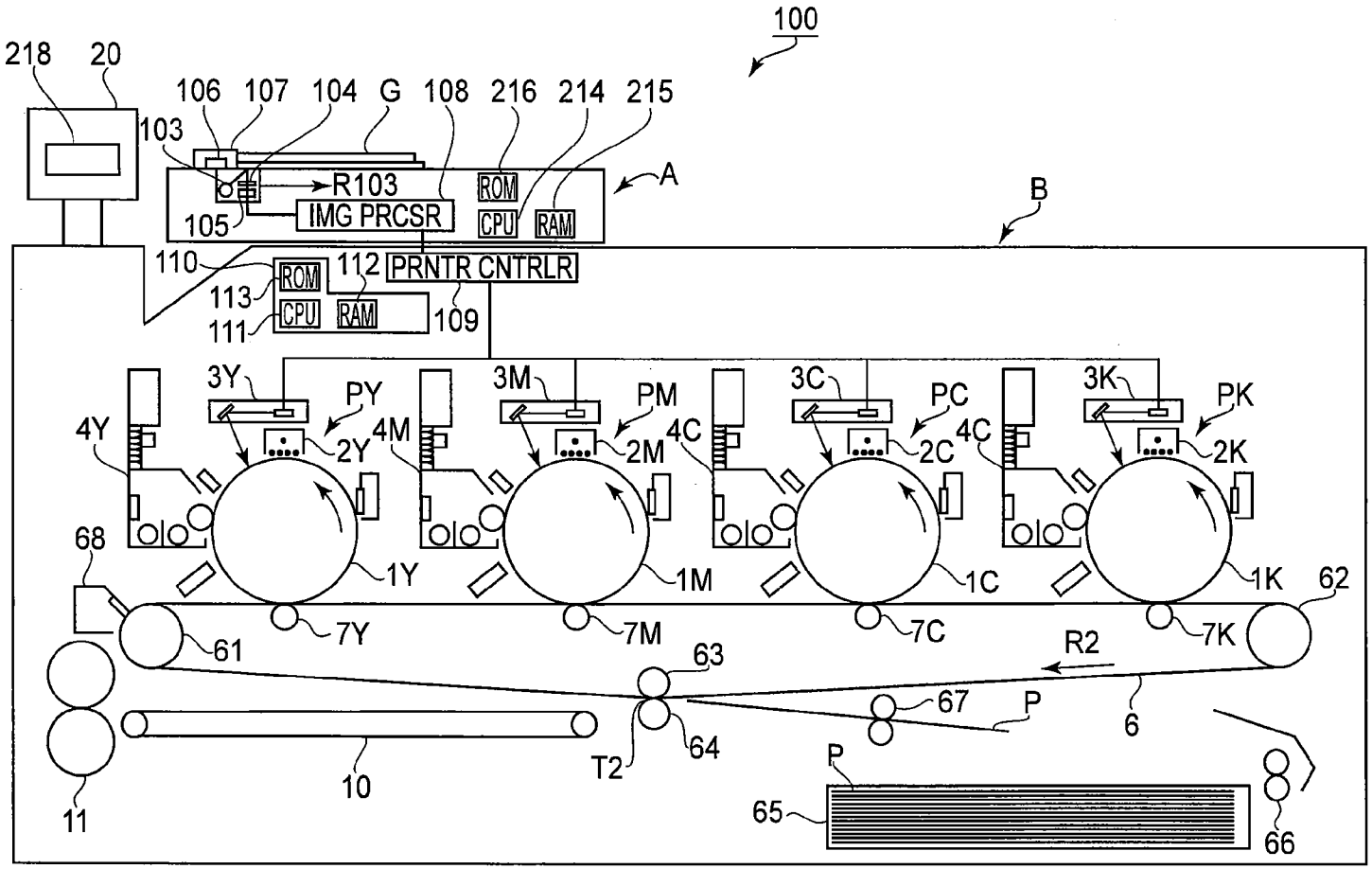
FIG. 1 is a sectional view of the image forming apparatus in the first preferred embodiment of the present invention, and shows the general structure thereof.

FIG. 1 is a sectional view of the image forming apparatus in the first embodiment of the present invention, and shows the general structure thereof.

Referring to FIG. 1, an image forming apparatus 100 is a full-color printer which has an intermediary transfer belt 6, and yellow, magenta, cyan, and black image forming portions PY, PM, PC, and PK, respectively, which are arranged in tandem along the intermediary transfer belt 6.

In the image forming portion PY, an image is formed of yellow toner (yellow toner image), on a photosensitive drum 1Y, and then, is transferred (first transfer) onto the intermediary transfer belt 6. In the image forming portion PM, an image is formed of magenta toner (magenta toner image), on a photosensitive drum 1M, and then, is transferred (first transfer) onto the intermediary transfer belt 6 so that it is layered on the yellow toner image on the intermediary transfer belt 6. In the image forming portion PC, an image is formed of cyan toner (cyan toner image), on a photosensitive drum 1C, and then, is transferred (first transfer) onto the intermediary transfer belt 6 so that it is layered on the toner images on the intermediary transfer belt 6. In the image forming portion PK, an image is formed of black toner (black toner image), on a photosensitive drum 1K, and then, is transferred (first transfer) onto the intermediary transfer belt 6 so that it is layered on the three images on the intermediary transfer belt 6.

After the transfer (first) of the four toner images, different in color, onto the intermediary transfer belt 6, the four toner images are conveyed to a second transfer portion T2, in which they are transferred all at once (second transfer) onto a sheet of recording medium P (which hereafter will be referred to simply as recording medium P. After the transfer of the four toner images, different in color, onto the recording medium P, the recording medium P is conveyed to a fixing apparatus 11, in which it is subjected to heat and pressure so that the toner images are fixed to the recording medium P. After the fixation of the toner images, the recording medium P is discharged from the main assembly of the image forming apparatus 100.

The intermediary transfer belt 6 is supported by a tension roller 61, a driver roller 62, and a backup roller 63, by being stretched around the rollers. It is circularly driven by the driver roller 62 at a preset process speed in the direction indicated by an arrow mark R2.

The recording mediums P are pulled out of a recording medium cassette 65. As they are pulled out, one of them is separated from the rest by a pair of separation rollers 66, and is sent to a pair of registration rollers 67. The registration roller 67 catch the recording medium P while remaining stationary, and then, keep the recording medium P on standby. Then, they send the recording medium P to the second transfer station with such timing that the recording medium P arrives at the second transfer portion T2 at the same time as the toner images on the intermediary transfer belt 6.

A second transfer roller 64 forms the second transfer portion T2 by being placed in contact with the intermediary transfer belt 6 backed up by the backup roller 63. As a positive DC voltage is applied to the second transfer roller 64, the toner images on the intermediary transfer belt 6, which are negative in polarity, are transferred (second transfer) onto the recording medium P.

The image forming portions PY, PM, PC, and PK are practically the same in structure, although they are different in the color of the toner (yellow, magenta, cyan, and black, respectively) used by the developing apparatuses (4Y, 4M, 4C, and 4K, respectively). Hereafter, unless it is necessary to show the differences among the four image forming portions, the suffixes attached to show the color of the toner they use, the suffixes will not be used.

Figure 4:
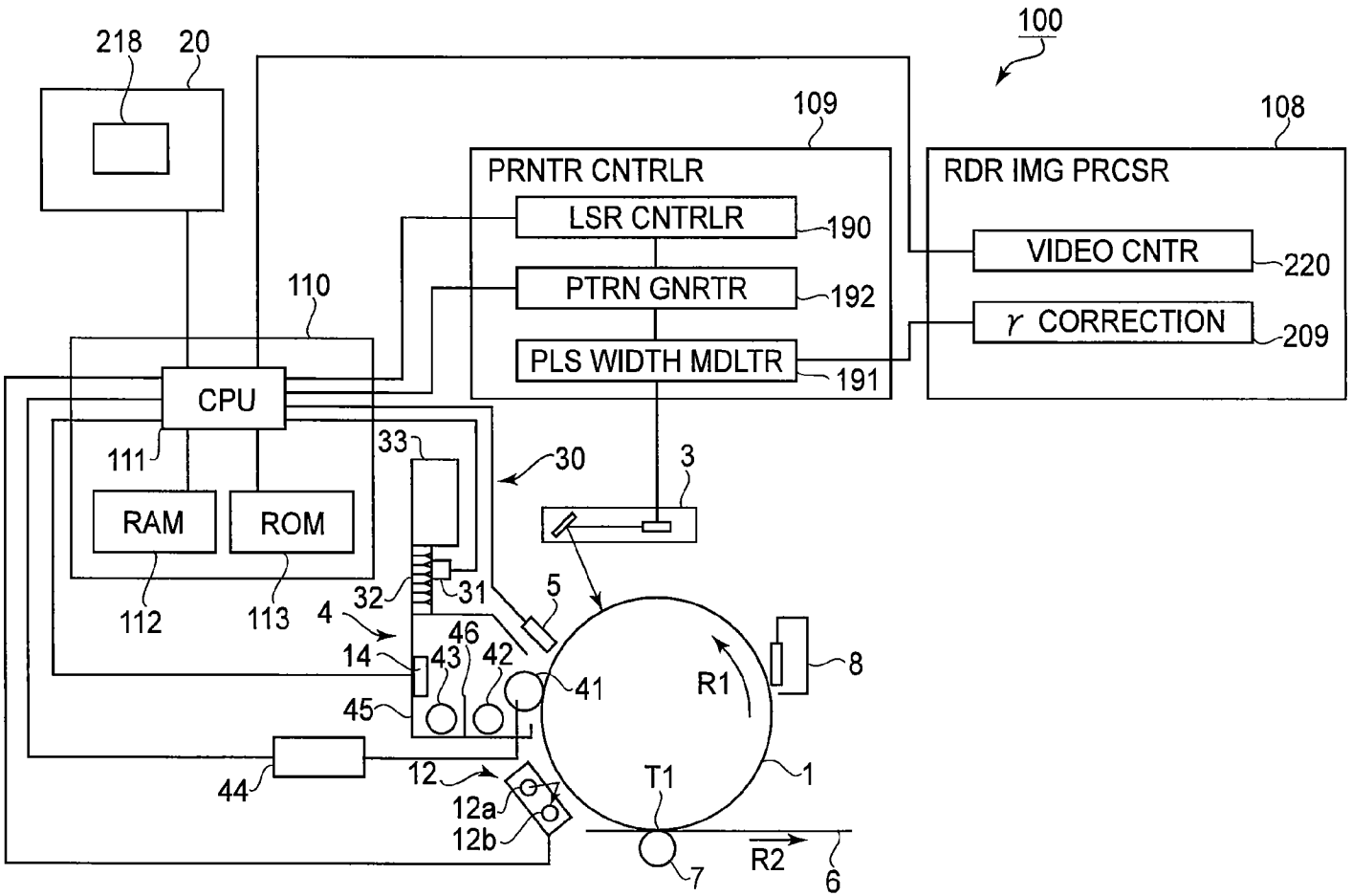
FIG. 4 is a block diagram of the control system of the image forming portion.

Referring to FIG. 4 along with FIG. 1, the image forming portion P has a photosensitive drum 1. It has also a charging apparatus 2, an exposing apparatus 3, a developing apparatus 4, a first transfer roller 7, and a cleaning apparatus 8, which are in the adjacencies of the peripheral surface of the photosensitive drum 1.

The photosensitive drum 1 is made up of an aluminum cylinder, and a negatively chargeable photosensitive layer which covers the entirety of the peripheral surface of the aluminum cylinder. It rotates at a preset process speed in the direction indicated by an arrow mark R1. The photoconductive layer is made of an organic photo-conductor, and is roughly 40% in near infrared light reflectivity (960 nm). However, it may be formed of such a photo-conductive substance as amorphous silicon, as long as the conductor is roughly the same in reflectivity as that of the organic photoconductor used in this embodiment.

The charging apparatus 2 is a scorotron charger. It uniformly charges the peripheral surface of the photosensitive drum 1 to negative polarity by irradiating the photosensitive drum 1 with charged particles effected by corona discharge. A scorotron charger has a piece of wire to which high voltage is applied, a grounded shield, and a grid to which a desired amount of voltage is applied. To the wire of the charging apparatus 2, a preset grid bias is applied from the grid bias power source (unshown). The photosensitive drum 1 is charged to a voltage level which is roughly the same level as the voltage applied to the grid portion, although the voltage level to which the photosensitive drum 1 is charged depends on the voltage applied to the wire.

The exposing apparatus 3 writes an electrostatic image of the image to be formed, on the charged portion of the peripheral surface of the photosensitive drum 1, by scanning the charged portion of the peripheral surface of the photosensitive drum 1 with the beam of laser light reflected by a rotating mirror. A voltage level (potential) sensor, which is an example of a voltage level detecting means, is capable of detecting the electrical potential level of an electrostatic image formed on the photosensitive drum 1 by the exposing apparatus 3. The developing apparatus 4 develops the electrostatic image on the photosensitive drum 1 into a visible image (image formed of toner; toner image) by adhering negatively charged toner to the electrostatic latent image on the photosensitive drum 1.

The first transfer roller 7 forms the first transfer portion T1 between the photosensitive drum 1 and intermediary transfer belt 6 by pressing the intermediary transfer belt 6 upon the photosensitive drum 1 from the inward side of the loop which the intermediary transfer belt 6 forms. As a positive DC voltage is applied to the first transfer roller 7, the negatively charged toner image on the photosensitive drum 1 is transferred (first transfer) onto the portion of the intermediary transfer belt 6, which is being moved through the first transfer portion T1.

The cleaning apparatus 8 removes the transfer residual toner, that is, the toner having escaped from being transferred onto the intermediary transfer belt 6, and therefore, remaining on the portion of the peripheral surface of the photosensitive drum 1 after the first transfer, by rubbing the peripheral surface of the photosensitive drum 1 with its cleaning blade.

The belt cleaning apparatus 68 removes the transfer residual toner, that is, the toner having escaped from the process of being transferred onto the recording medium P, having moved through the second transfer portion T2, and remaining on the intermediary transfer belt 6, by rubbing the intermediary transfer belt 68 with its cleaning blade.

The image forming apparatus 100 has a control panel 20, which has a display 218. The control panel 20 is in connection with the CPU 214 of an image reader portion A, and the control portion 110 of the image forming apparatus 100. A user is allowed to input variables such as image type, number of images to be formed, etc, through the control panel 20. The printer portion B forms images based on the inputted variables.

<Image Reading Apparatus>

Figure 2:
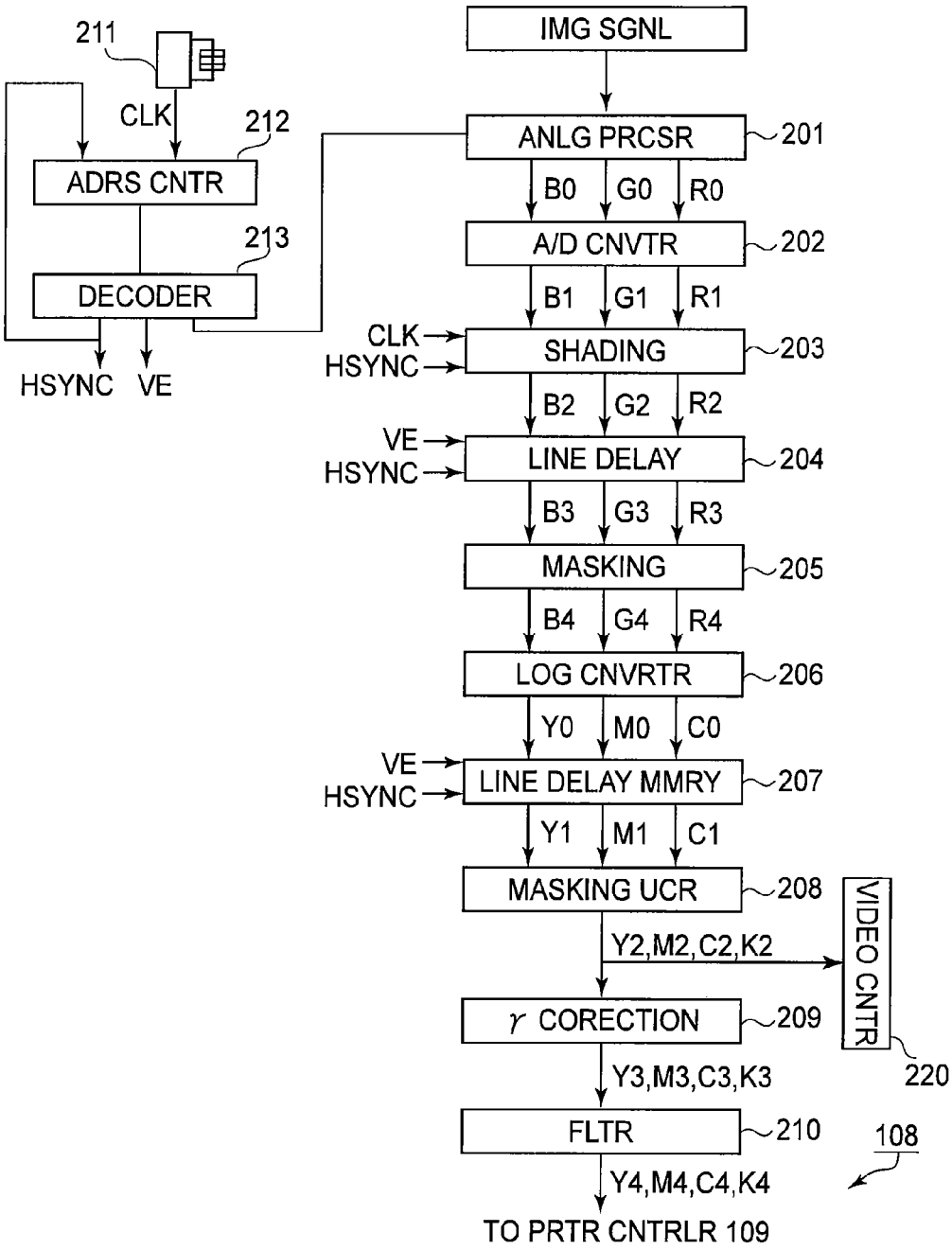
FIG. 2 is a block diagram of the signal processing sequence carried by an image processing portion.
Figure 3:
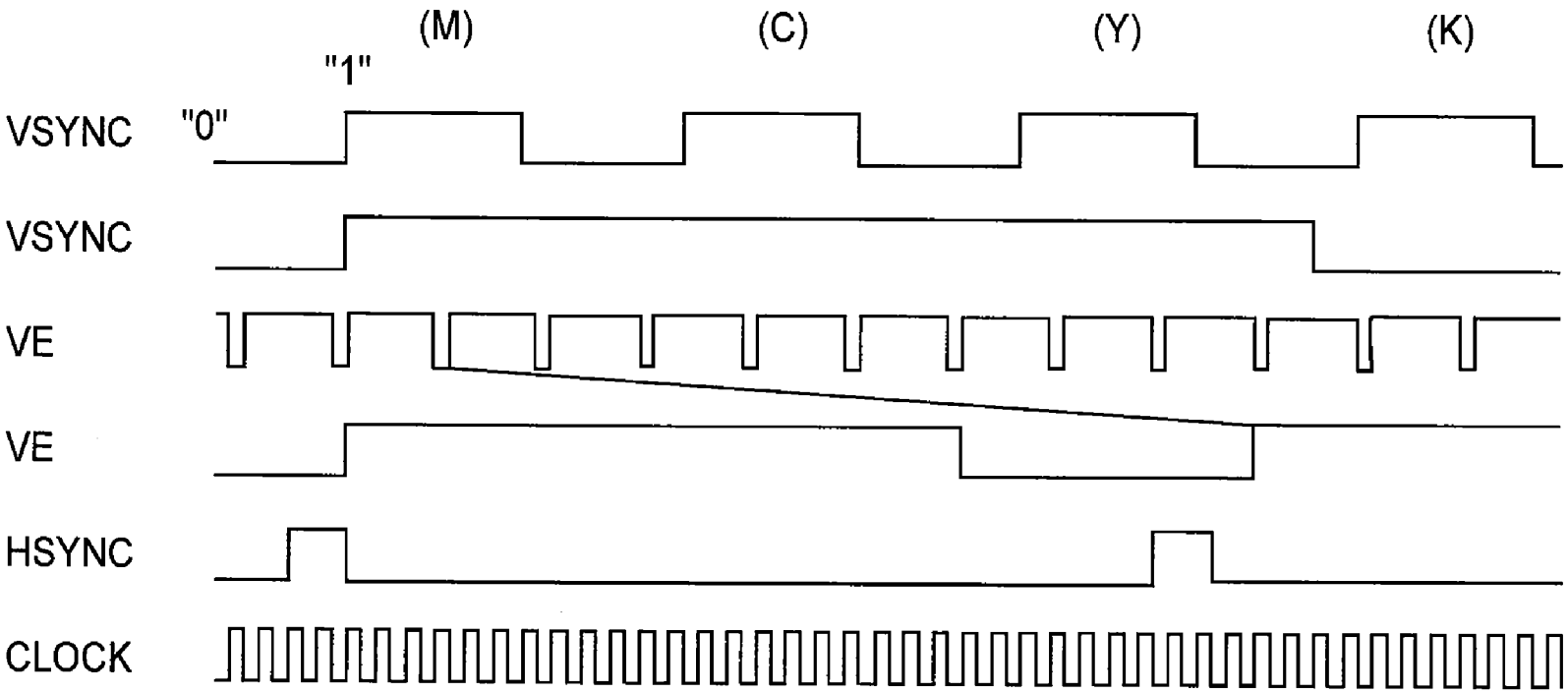
FIG. 3 is a timing chart which shows the timings with control signals are processed by the signal processing portion of the image reading portion.

FIG. 2 is a block diagram of the signal processing sequence of the image processing portion of the image reading apparatus. FIG. 3 is a drawing for describing the control signal timings of the image processing portion.

Referring to FIG. 1, an original G is placed on the original placement glass platen 10 so that the image bearing surface of the original faces downward. The image reading apparatus A (reader portion) reads the image of the original. More specifically, the original is illuminated by a light source 103, and the light reflected by the original is focused on a CCD sensor 105 through an optical system. The CCD sensor 105 has a group of line sensors, that is, red (R), green (G), and blue (B) CCD sensors, which generate signals corresponding to red, signals corresponding to green, and signals corresponding to blue, respectively. The optical image reading unit which includes the light source 103, optical system 104, and CCD sensors 105 are moved in the direction indicated by an arrow mark R103. As it is moved, it converts the image of the original G into image formation data, that is, electric signals sequences which correspond one for one to the scanning lines along which it was moved.

The image reading apparatus 102 is provided with an original positioning member 107, which is on the original placement glass platen 102. The original is precisely positioned relative to the image reading apparatus 102 by being placed in contact with the original positioning member 107. Also on the original placement glass platen 102 is a referential white "color" setting plate 106 for setting the shading for the CCD sensors 105 in terms of the thrust direction.

The image signals obtained by the CCD sensors 105 are processed by the image processing portion 108, and are sent to a printer control portion 109 (image processing portion), in which they are processed again.

Next, referring to FIG. 2, a clock signal generating portion 211 generates a clock signal per picture element. A primary scan address counter 212 counts the clock signals generated by the clock signal generating portion 211, and generates an address per picture element per primary scan line. As the primary scan address counter 212 finishes generating the address per picture element per primary scan line, it is cleared by an HSYNC signal, and begins to count the aforementioned clock signals to generate the address per picture element for the next primary scan line.

A decoder 213 generates CCD driving signals, such as shift pulse, reset pulses, etc., per scan line, by decoding the primary scan addresses from the primary scan address counters 212. The decoder 213 generates also VE signals and line synchronization HSYNC. A VE signal is a signal that shows the effective range for the signals obtained by the CCD sensors 105 per scan line.

Next, referring to FIG. 3, a VSYNC signal is a signal that shows the effective range of an image signal in terms of the secondary scan direction. The original is read (scanned) during a period in which the value (logic) of the VSYNC is "1", to generate output signals for M, C, Y, and K. A VE signal is a signal that shows the effective range of an image signal in terms of the primary scan direction. When the value (logic) of the VE signal is "1", the timing with which the scanning of the original in the primary scan direction is set. It is used primarily to control the count of line delay. A clock signal is a signal for synchronizing picture elements. It is used for transferring image data so that the data is transmitted at the timing with which the signal starts up from "0" to "1".

Referring again to FIG. 2, the image signals outputted by the CCD sensors 105 are inputted into the analog signal processing portion 201, in which they are adjusted in gain and offset, and are converted into 8-bit digital image signals R1, G1, and B1 per color signal by an A/D converter. The digital image signals R1, G1, and B1 are inputted into a shading correcting portion 203, in which they are corrected in shading per color with reference to the signals obtained by reading the white referential plate 106.

There is a preset amount of distance between the adjacent two line sensors of the CCD sensors 105. Therefore, a line delay circuit 204 compensates for the spatial deviation of the digital image signals R2, G2, and B2 in terms of the secondary scan direction. More specifically, each of R and G signals is aligned with the corresponding B signal by delaying the R and G signal in terms of the secondary scan direction.

An input masking portion 205 converts the color space of the read image, which is determined by the spectral characteristic of the R, G, and B filters of the CCD sensors 105, into the standard color space of the NTSC, by carrying out the following matrix computation.

$$\begin{bmatrix} R4 \\ G4 \\ B4 \end{bmatrix} = \begin{bmatrix} a11 & a12 & a13 \\ a21 & a22 & a23 \\ a31 & a32 & a33 \end{bmatrix} \begin{bmatrix} R3 \\ G3 \\ B3 \end{bmatrix} \quad \text{Formula 1}$$

A light amount/image density converting portion 206 (LOG conversion portion) is made up of a lookup table (LUT) ROMs. It converts the luminance signals of R4, G4, and B4 into the density signals M0, C0, and B0 of the magenta (M), cyan (C), and yellow (Y) image signals, respectively. A line delay memory 207 delays the image signals of M0, C0, and Y0 by the amount equal to the line delay to determinative signals such as UCR, FILTER, SEN, etc., generated from the R4, G4, and B4 signals, by black letter determinating portion (unshown). A masking-UCR circuit 208 extracts the signals for black (K) from the inputted three primary color signals M1, C1, and Y1, and also, carries out the computation for compensating for the turbidity of the coloring materials in the printing portion B. Further, the masking-UCR circuit 208 sequentially outputs M2, C2, Y2, and K2 signals having a preset bit width (8 bit), each time a reading operation is carried out.

A γ-correction circuit 209 makes image density correction, in the reader portion A, so that the image density matches the idealistic gradational characteristic of the printer portion B. More specifically, the γ-correction circuit 209 performs a density conversion operation, using a gamma correction LUT (gradation correction table) stored in a 256 byte RAM or the like. A space filter processing portion 210 (output filter) performs an edge emphasizing process or an edge smoothing process.

<Exposing Apparatus>

FIG. 4 is a block diagram of the control system of the image forming apparatus 100. Referring to FIG. 4, the image forming apparatus 100 has a control portion 110 which integrally controls the image forming operation of the apparatus. The control portion 110 has a CPU 110 and a ROM 113.

The exposing apparatus 3 is a laser scanner having a rotatable mirror. It has a laser amount control circuit 190 which controls the exposure output so that a preset level of image density is obtained relative to the laser output signal. Further, the exposing apparatus 3 turns on or off, with a pulse width set by a pulse width modulation circuit 191, in response to a driver signal generated using the toner compensation table (LUT) of the γ-correction circuit 209.

Laser output signals capable of achieving a preset level of image density based on the relationship between a preset laser output signal and image density level, are stored, as a gradation correction table (LUT), in the γ-correction circuit 209. The laser output signal is controlled according to this gradation correction table.

The image signals M4, C4, Y4, and K4 which are in surface order, are processed by the space filter processing portion 210 shown in FIG. 2, and are sent to a printer control portion 109. Then, an image, the density gradation (binary areal gradation) of which is set by the exposing apparatus 3 which uses PWM (pulse width modulation), is recorded.

That is, the pulse width modulation circuit 191 of the printer control portion 109 generates and outputs laser driving pulse, which correspond in width (length in time) to the signals for each picture element of the image to be formed. More specifically, for the signal for a picture element which is higher in density, it generates a wider driving pulse, whereas for the signal for a picture element which is lower in density, it generates a narrower driving pulse. Further, for the signal for a picture element which is medium in density, it generates a driving pulse which is medium in width.

The binary laser driving pulses outputted from the pulse width modulation circuit 191 are supplied to the semiconductor laser of the exposing apparatus 3, and cause the semiconductor laser to emit light for a length of time which is proportional to the driving pulse width. Thus, for a picture element which is higher in density, the semiconductor laser is driven longer, whereas for a picture element which is lower in density, the semiconductor layer is driven for a shorter length of time.

Thus, the dot size (area) of an electrostatic latent image on the photosensitive drum 1 is affected by the density of a picture element. For a picture element which is higher in density, the exposing apparatus 3 exposes the peripheral surface of the photosensitive drum 1 across a longer range in terms of the primary scan direction, whereas for a picture element which is lower in density, it exposes the peripheral surface of the photosensitive drum 1 across a shorter range in terms of the primary scan direction. Naturally, the toner consumption for a picture element which is higher in density is greater than that for a picture element which is lower in density.

<Developing Apparatus>

The developing apparatus 4 uses a developing method which uses a two-component developer which is a mixture of nonmagnetic toner and magnetic carrier. The nonmagnetic toner (toner) is made up of styrene resin as binder, and a coloring agent dispersed in the resin. It is 5 μm in average diameter. The developing apparatus 4 stirs the two-component developer to positively charge the magnetic carrier, and negatively charge the toner.

The developing apparatus 4 has a developer container 45 and a partition wall 46. The partition wall 46 is perpendicular to the surface of the sheet of paper on which FIG. 4 is, and separates the internal space of the developer container 45 into a first chamber (development chamber) and a second chamber (developer stirring chamber). The developing apparatus 4 has also a nonmagnetic development sleeve 41 and a magnet. The development sleeve 41 is in the first chamber. The magnet is a magnetic field generating means, and is inside the development sleeve 41.

The developing apparatus 4 has also a first screw 42 and a second screw 43. The first screw 42 is in the first chamber, and conveys the developer in the first chamber, while stirring the developer. The second screw 43 is in the second chamber, and conveys the developer in the second chamber, in the opposite direction from the direction in which the first screw 42 conveys the developer in the first chamber, while stirring the developer in the second chamber. Further, the image forming apparatus 100 is provided with a replenishment toner container 33, from which replenishment toner is supplied to the developer container 45. The second screw 43 stirs the body of toner supplied from the replenishment toner container 33, into the body of preexisting developer in the developing apparatus 4 to make uniform in toner density the combination of the body of freshly supplied toner and the body of preexisting developer in the developer container 45.

The partition wall 46 has a pair of developer passages, one of which connects the front portion (viewer side of drawing) of the first chamber and the front end portion of the second chamber, and the other of which connects the rear end portion (opposite side from viewer side) of the first chamber and the rear end portion of the second chamber. The developer in the developer container 45 is circularly moved in the developer container 45, while being stirred, by the force applied to the developer by the first and second screws 42 and 43, respectively, through the pair of developer passages. That is, the developer in the first chamber is reduced in toner density by the toner consumption resulting from a development operation, and then, is moved into the second chamber through one of the aforementioned developer passages. Then, the developer having been reduced in toner density and moved into the second chamber is replenished with toner, being restored in toner density, and then, is moved back into the first chamber through the other developer passage.

The two-component developer in the first chamber is coated on the peripheral surface of the development sleeve 41 by the first screw 42. As it is coated, it is made to crest by the magnetic force from the aforementioned magnet in the development sleeve 41. Then, as the development sleeve 41 is rotated, the developer layer on the development sleeve 41 is regulated in thickness by a developer layer thickness regulating member (blade). Then, as the development sleeve 41 is further rotated, the developer layer is conveyed to the development area in which the developer layer squarely faces the peripheral surface of the photosensitive drum 1.

To the development sleeve 41, a development bias voltage (oscillatory voltage), which is a combination of a negative DC voltage Vdc and an alternating voltage, is applied from a development bias power source 44. Thus, the negatively charged toner particles transfer onto the points of the peripheral surface of the photosensitive drum 1, which have become positive in polarity relative to the development sleeve 41. Consequently, the electrostatic image on the photosensitive drum 1 is developed in reverse.

A developer supplying apparatus 30 has the replenishment toner container 33 for storing the replenishment toner. The replenishment toner container 33 is above the developing apparatus 4. There is a toner conveyance screw 32 in the bottom portion of the replenishment toner container 33. The toner conveyance screw 32 is rotated by a motor 31.

The toner conveyance screw 32 conveys the replenishment toner into the developing apparatus 4 through the toner conveyance passage in which the toner conveyance screw is located. The toner conveyance by the toner conveyance screw 32 is controlled by the CPU of the control portion 110, which controls the rotation of the motor 31 by way of a motor driving circuit (unshown). The control data or the like which are to be supplied to the motor driving circuit are stored in a RAM 112 which is in connection with the CPU 111. The replenishment toner container 33, motor 31, toner conveyance screw 32, etc., make up the apparatus 30 which replenishes the developing apparatus 4 with toner.

As electrostatic latent images are continuously formed on the photosensitive drum 1 and developed, the developer in the developing apparatus 4 reduces in toner density. Thus, the control portion 110 keeps the developer in the developing apparatus 4 as stable as possible at a preset level by controlling the amount by which the developing apparatus 4 is replenished with the toner from the replenishment toner container 33.

The image forming apparatus 100 forms an electrostatic image on its photosensitive drum 1 using a digital image forming method based on areal gradation. Therefore, the toner supplying operation is carried out based on the density of the image of the test patch, which is detected by an image density level sensor 12, and also, based on the digital image signal which corresponds to each picture element of an electrostatic latent image to be formed on the photosensitive drum 1.

More concretely, the control portion 110 (first control portion) obtains a total amount of toner to be supplied per copy to the developing apparatus 4, by adding the replenish toner amount adjustment amount Mp obtained by the patch image detection ATR, to the basic toner replenishment amount obtained by the video count ATR. The total amount (Mv) of toner to be supplied per copy to the developing apparatus 4 is set by adding the amount by which the developer in the developing apparatus 4 is insufficient, and which is detected from the formed image of the test patch, to the presumptive toner consumption amount per copy, which can be predicatively calculated, using Formula 1:

$$Msum\ (\text{total amount by which toner is to be supplied}) = Mv + (Mp/\text{patch image density detection frequency}) \quad \text{(Formula 1)}$$

wherein My stands for the predicted amount by which the toner in the developer in the developing apparatus 4 is going to be consumed, and which is determined based on the video count ATR; and Mp stands for the amount by which the developing apparatus 4 is to be replenished with toner, and which is obtained by the patch image detection ATR.

<Video Count ATR>

The basic replenishment amount Mv is obtained based on the image signals generated by the image reading apparatus A (reader portion), or the image signals sent from a computer or the like. The structure of the circuit which processes these image signals is as shown by FIG. 2, which is a block diagram of the control system of the image forming apparatus 100.

Referring to FIG. 2, the image signals M2, C2, Y2, and K2 which the masking-UCR circuit 203 outputs are sent to a video counter 220 as well, in which the image densities of all the picture elements are added to obtain the total video count for each of the C, M, Y, and K images.

The video counter 220 obtains the density value of each picture element by processing the image signals M2, C2, Y2, and K2, and calculates the total video count for each of the C, M, Y, and K images, respectively. For example, in a case where a halftone image, the density level of which is 128, is formed across the entirety of a sheet of recording medium, which is A3 in size (16.5×11.7 inch) at 600 dpi, the total video count value is 128×600×600×16.5×11.7=8,895,744,000.

The total video count value is converted into basic replenishment amount Mv using the table which shows the relationship between the video count values obtained in advance and stored in the ROM 113, and the amount by which the developing apparatus 4 is to be replenished with toner. The basic replenish amount Mv is calculated for each image each time an image is formed.

<Patch Image Detection ATR>

Figure 5:
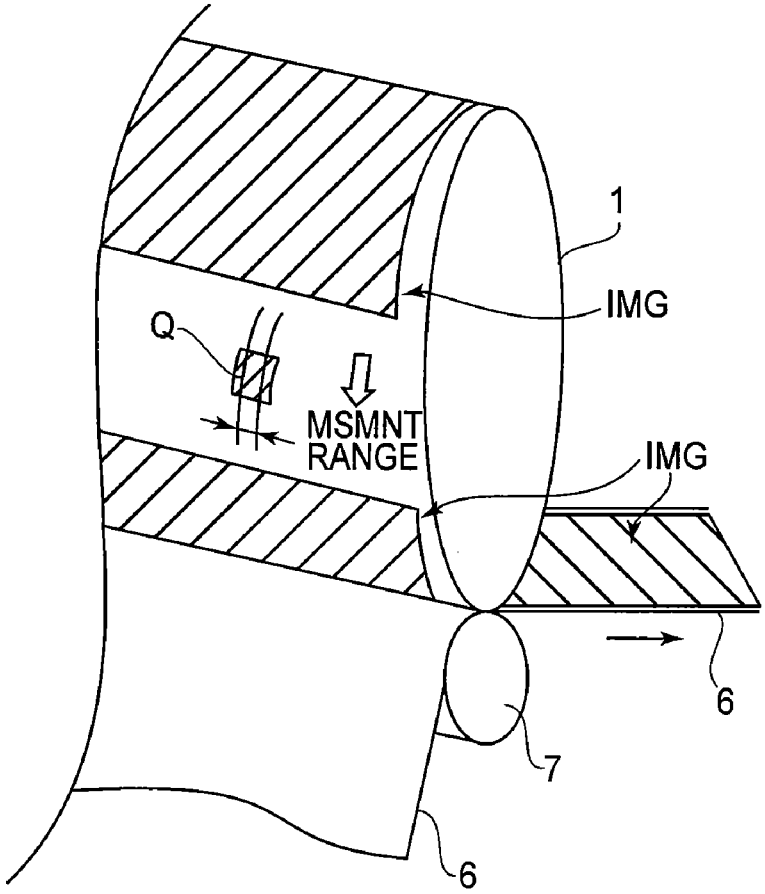
FIG. 5 is a drawing for describing the process for forming an image of the test patch.
Figure 6:
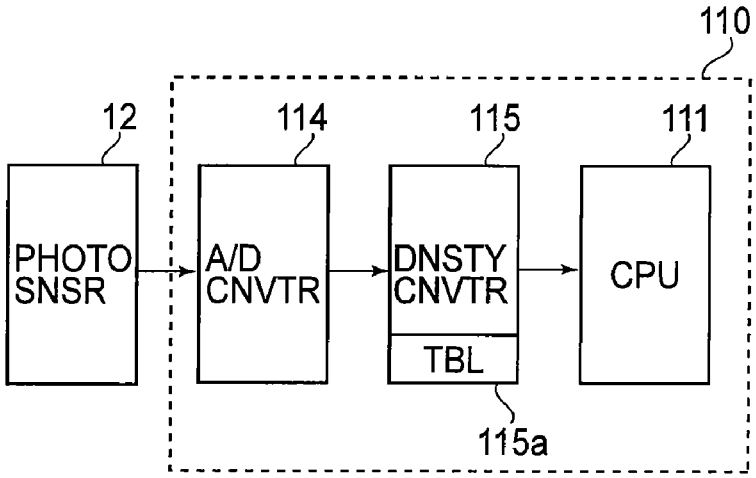
FIG. 6 is a block diagram of the process for measuring the density of the test patch image.
Figure 7:
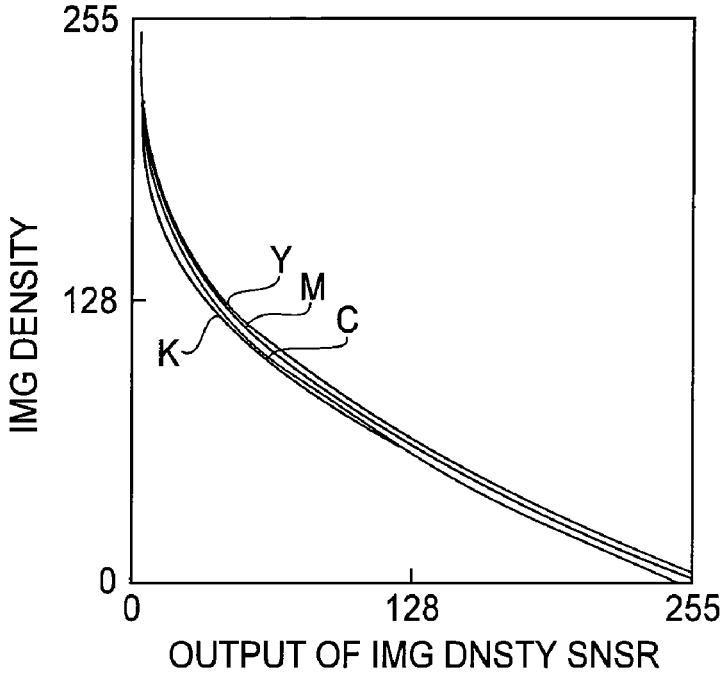
FIG. 7 is a graph for showing the relationship between the image density and photosensor output.
Figure 8:
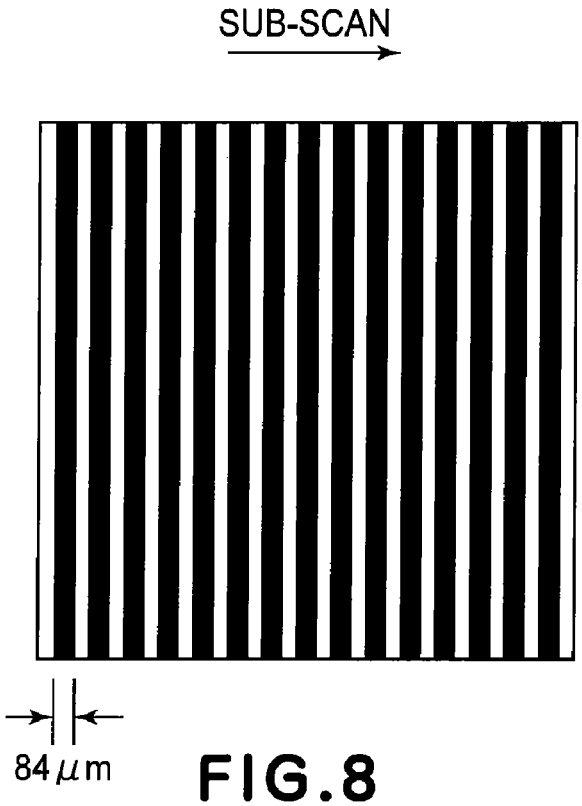
FIG. 8 is a drawing of the test patch.

FIG. 5 is a drawing for describing the process for forming an image of a test patch. FIG. 6 is a drawing for describing the process for measuring the density of the test patch image. FIG. 7 is a graph which shows the relationship between the image density and photosensor output. FIG. 8 is a drawing of the test patch.

Referring to FIG. 5 along with FIG. 4, the control portion 110 forms a test patch image each time a preset number of intended images are formed if, images are continuously formed by a number larger than the preset number. For example, in an image forming operation in which 25 or more copies of image are continuously formed, an image of a test patch Q, which is patterned for image density detection, is formed on the photosensitive drum 1 across the area (image interval) between the portion which corresponds to the trailing end of the preceding image, and the portion which corresponds to the front end of the next image. That is, an image of test patch Q is formed during the interval between a set of 24 copies and the next set of 24 copies.

The control portion 110 write an "electrostatic image" of the test patch on the photosensitive drum 1 by controlling the exposing apparatus 3, and then, forms a visible image of the test patch Q by developing the "electrostatic image" with the use of the developing apparatus 4. Then, the density of the image of the test patch Q is detected by the image density level sensor 12. Then, the control portion 110 uses the detected density of the image of the test patch Q to control the amount by which the developing apparatus 4 is to be replenished with toner, by carrying out the patch detection ATR, so that the image density of the next image of the test patch Q will equal the standard density.

The printer control portion 109 has a patch image formation signal generation circuit 192 (pattern generator), which generates test patch formation signals, which correspond in signal level to a preset image density level. The test patch generation signals from the pattern generator 192 are supplied to the pulse width modulation circuit 191, by which laser driving pulses, which correspond in width to the above-mentioned preset density level. These laser driving pulses are supplied to the semiconductor laser of the exposing apparatus 3, causing thereby the semiconductor laser to emit a beam of laser light for a length of time which corresponds to the pulse width, so that the peripheral surface of the photosensitive drum 1 is scanned by (exposed to) the beam of laser light. Consequently, an electrostatic image of the test patch, the density level of which matches the aforementioned preset density level, is effected on the photosensitive drum 1. This electrostatic image of the test patch is developed by the developing apparatus 4.

The image density level sensor 12 (patch detection ATR sensor) for detecting the density level of the image of the test patch Q is positioned so that it faces the portion of the peripheral surface of the photosensitive drum 1, which is immediately on the downstream side of the developing apparatus 4 in terms of the rotational direction of the photosensitive drum 1. The image density level sensor 12 has: a light emitting portion 12*a* made up of light emitting element such as a LED or the like; and a photosensitive portion 12*b* made up of a photosensitive element such as a photosensitive diode or the like. It is structured so that the photosensitive portion 12*b* detects only the regular reflection light from the photosensitive drum 1.

The image density level sensor 12 measures the amount of the light reflected by the photosensitive drum 1 with such a timing that the image of the test patch Q formed between the aforementioned image interval passes below the image density level sensor 12. The signals resulting from this measurement are inputted into the CPU 111.

Next, referring to FIG. 6, as the light (near infrared light) reflected by the photosensitive drum 1 is inputted into the image density level sensor 12, it is converted into analog electrical signals, the voltage of which is in a range of 0-5 V. Then, the analog electric signals are converted into an 8-bit digital signals by an A/D conversion circuit 114 with which the control portion 110 is provided. Then, these 8-bit digital signals are converted into density level data by a density level conversion circuit 115 with which the control portion 110 is provided.

Next, referring to FIG. 7, as the density of the image of the test patch Q formed on the photosensitive drum 1 is converted in steps into areal gradation levels, the output of the image density level sensor 12 changes in proportion to the density level of the image of the test patch Q. Here, before the adhesion of toner to the photosensitive drum 1, the output of the image density level sensor 12 is 5 V. The density of the image of the test patch Q is read in 255 levels.

The greater the picture element formed on the photosensitive drum 1, in the ratio of the area covered with toner, the higher in image density, and the higher the picture element in image density, the smaller the output of the image density level sensor 12. A table 115*a* for converting the output of the image density level sensor 12 into density level signals for each color is prepared in advance in consideration of the above described properties of the image density level sensor 12. The table 115*a* is stored in the memory portion of the density level conversion circuit 115. Therefore, the density level conversion circuit 115 can precisely read the density level of the image of the test patch Q. The density level conversion circuit 115 outputs density level information to the CPU 111.

The image density level sensor 12 has logarithmic properties. That is, the higher the density level the sensor 12 detects, the smaller the output of the sensor 12; the higher the density level the sensor 12 detects, the gentler in angle the tangential line to the line which shows the relationship between the density level detected by the sensor 12 and the output of the sensor 12. In other words, the higher the image density level the sensor 12 detects, the smaller the changes in the output of the sensor 12, and therefore, the less precisely can the sensor 12 detect the density. Therefore, an image, shown in FIG. 18, which was lowered in image density level by lowering it in areal gradation level by placing a space which equals in width and length to a single scan line between every adjacent two lines which equal in width and length to two scanning line, that is, an image which is not as high in density level as a solid image, is used as the test patch. That is, the test patch image formed on the peripheral surface of the photosensitive drum 1 through the aforementioned exposing process is 600 dpi in resolution level, and has one space for every two lines in terms of the secondary scan direction.

Next, referring to FIG. 4, in the case of Formula 1 given above, the toner replenishment amount Mp is obtained as the difference ΔD between the density level (referential level) of the image of the test patch Q formed by using the initial supply of developer in the developing apparatus, and the detected density level of the test patch image formed by the developer in the developing apparatus after the formation of a preset number of images (copies). For example, the amount ΔDrate of change which occurred to the measured density level of the image of the test patch Q as the amount of the toner in the developing apparatus 4 became different by 1 g from the referential amount is obtained in advance, and is stored in the ROM 113. This amount is used by the CPU 111 to calculates the replenishment amount Mp using Formula 2:

$$Mp=\Delta D/\Delta D\text{rate} \qquad \text{(Formula 2).}$$

Incidentally, during each of the intervals between the patch detection ATRs, in which the developing apparatus 4 is replenished with toner by amount Mp, replenishment toner is supplied to the developing apparatus 4 as evenly as possible across the interval, in order to prevent the image forming apparatus 100 from suddenly changing in color tone. If the developing apparatus 4 is supplied with replenishment toner all at once by the amount Mp while the first image is formed after the completion of the patch detection ATR, it is possible that the developing apparatus 4 may be replenished with an excessive amount of toner, that is, the overshooting may occur. In the case of Formula 2, therefore, the amount Mp is divided by the frequency with which the patch detection ATR is carried out in order to evenly distribute replenishment toner across the patch detection ATR interval.

The CPU 111 of the control portion 110 obtains the total amount Msum by which the developing apparatus 4 is to be supplied with toner, using Formula 1, as described above. Then, it controls the motor 31 to rotate the toner conveyance screw 32 so that toner is supplied from the replenishment toner container 33 to the developer container 45 by the total amount Msum.

However, this creates the following problem. That is, if it is determined by the patch detection ATR that the image density level is lower than the satisfactory level, the developing apparatus 4 is to be replenished with toner. However, if the developing apparatus 4 is replenished with toner when the toner density level (T/D ratio), which corresponds to the weight ratio of the toner in the two-component developer in the developer container 45 is no less than 11%, it is possible that unsatisfactory images may be formed. On the other hand, if it is determined by the patch detection ATR that the image of the test patch Q is higher in density than the satisfactory level, the developing apparatus 4 is not to be replenished with toner for a while. However, if the developing apparatus 4 is not replenished with toner when the toner density level (T/D ratio), which corresponds to the weight ratio of the toner in the two-component developer in the developer container 45 is no more than 6%, it is possible that development failure will occur.

Therefore, the CPU 111 continuously watches the toner ratio in the two-component developer by carrying out the inductor ATR. If it determines that the toner density of the two-component developer has become higher than 11%, it reduces the amount by which the developing apparatus 4 is replenished with toner, or stops the replenishment. If it determines that the toner density of the two-component developer has fallen below 6%, it forcefully replenishes the developing apparatus 4 with toner.

<Inductor ATR>

Referring again to FIG. 4, in order to detect the toner density level of the two-component developer, the developing apparatus 4 is provided with a built-in toner density level sensor 14 as toner density level detecting means. The control portion 110 sets a toner density range (range in which amount by developing apparatus 4 is replenished with toner is to be controlled) by carrying out the inductor ATR.

The toner density level sensor 14 is positioned so that it remains in contact with the body of developer in the developer container 45 while the body of developer is being circularly moved in the developer container 45. The toner density sensor 14 has a driving coil, a referential coil, and a detection coil. It outputs signals which correspond to the permeability of the developer. As a high frequency bias is applied to the driving coil, the output bias of the detection coil changes in proportion to the toner density of the developer. Thus, the toner density of the developer is obtained by comparing the output bias of the detection coil with the output bias of the referential coil.

The control portion 110 converts the result of the detection by the toner density sensor 14 into toner density level using the conversion formula in the ROM 113. The toner density T/D of the developer in the developing apparatus 4 is obtained by the CPU 111 based on the result of the measurement by the toner density sensor, using Formula 3 given below:

$$T/D=(SGNL\text{ value}-SGNLi\text{ value})/\text{Rate}+\text{Initial }T/D \qquad \text{(Formula 3)}$$

SGNL value: output value of toner density sensor

SGNLi value: initial output value of toner density sensor,

Rate: sensitivity.

As the initial T/D and SGNLi value, those obtained during the startup period are used. Rate is the sensitivity of ΔSGNL to T/D, which is measured in advance as one of the properties of the toner density sensor 14. These constants (initial T/D, SGNLi value, and Rate) are stored in the RAM 112 of the control portion 110.

As the toner density T/D of the two-component developer in the developing apparatus 4, which is obtained through the above described process, falls outside the preset range (becomes higher than top limit, or lower than bottom limit), the control portion 110 (second control portion) begins to restrict the replenishment toner control carried out by the patch detection ATR. That is, the control portion 110 (second control portion) restricts the amount by the developing apparatus 4 is replenished with toner by the toner supplying apparatus, or makes the toner supplying apparatus forcefully replenish (supply) the developing apparatus 4 with toner, by activating the motor 31 in response to the signal from the toner density sensor 14.

However, restricting the toner replenishment control makes it impossible for the patch detection ATR to control the amount by which toner is charged. Thus, the image forming apparatus 100 decreases in the reproducibility of the ratio between the amount by which toner is adhered to the photosensitive drum, and the amount of development contrast. Consequently, the amount by which toner adheres to the electrostatic image of the test patch image falls outside the normal range. Naturally, therefore, it becomes difficult to keep the developing apparatus 4 stable in image density and color tone.

COMPARATIVE EXAMPLE

Figure 9:
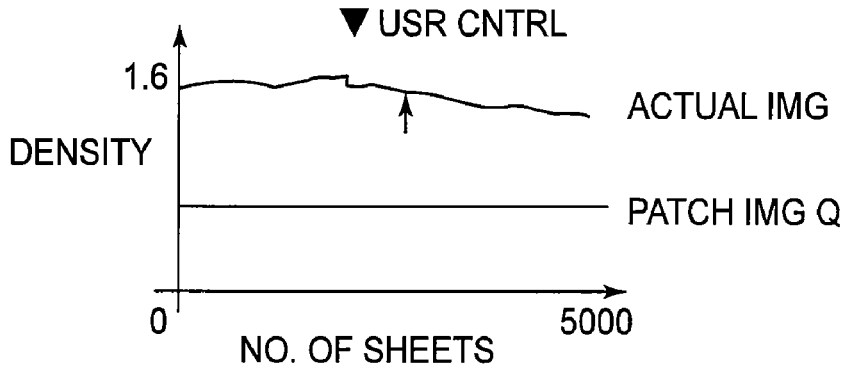
FIG. 9 is a drawing for describing the comparative control.
Figure 9:
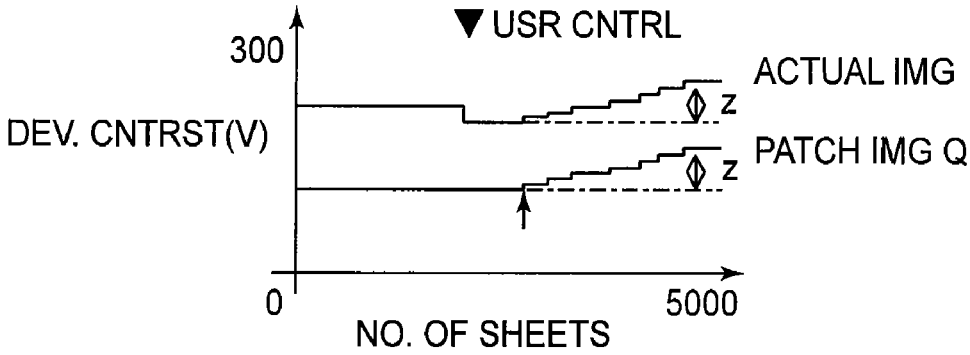
Figure 9:
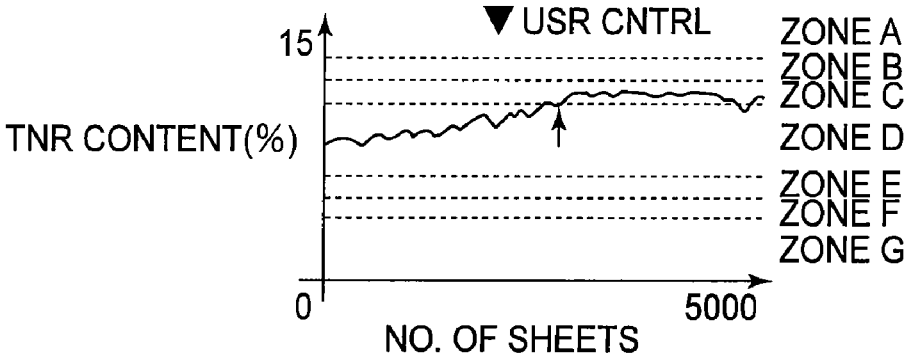
Figure 10:
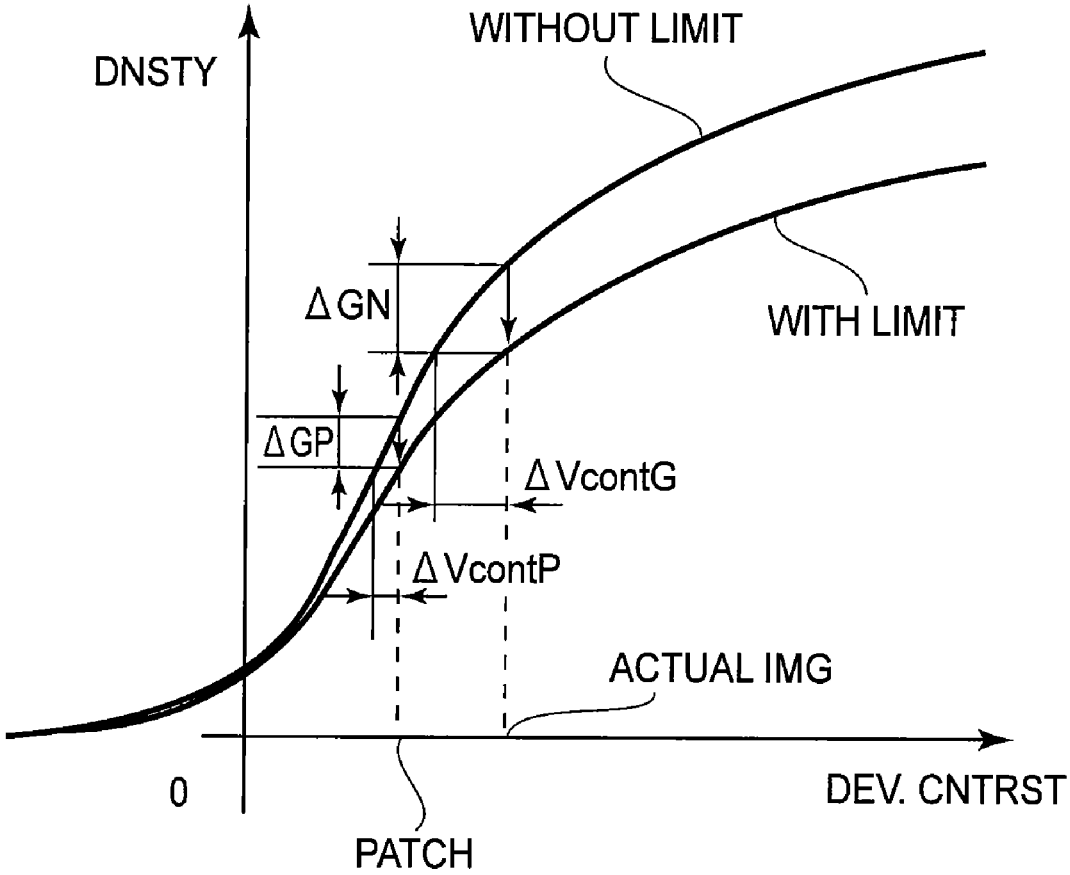
FIG. 10 is a drawing for describing the amount of development contrast necessary to form images which are accurate in terms of highest level of density.

FIG. 9 is a drawing for describing a comparative control. FIG. 10 is a drawing for describing the amount of the development contrast necessary to adjust the image forming apparatus in the highest level of density. FIG. 9(*a*) shows the shifting of the density of the test patch image and that of the maximum density of an ordinary image, and FIG. 9(*b*) shows the shifting of the development contrast of the test patch image and that of an ordinary image. FIG. 9(*c*) shows the shifting of the toner density which occurs during a continuous image forming operation.

Referring to FIG. 4, in the case of the example of the comparative control, the control portion 110 changes the exposing apparatus 3 in the amount of the exposure output to adjust the developing apparatus 4 in the amount of development contrast form the formation of an electrostatic image of the test patch.

Figure 12:
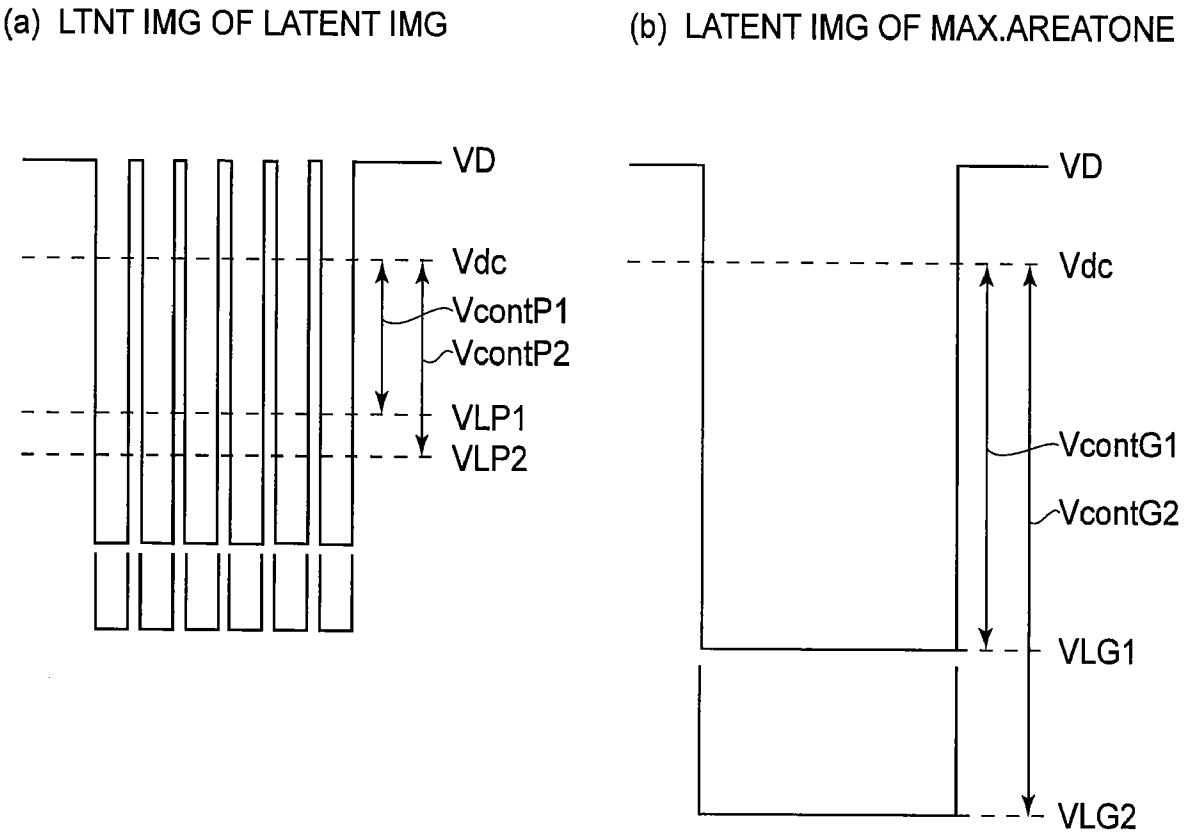
FIG. 12 is a drawing for describing the development contrast adjustment in the first embodiment.

Incidentally, development contrast is the difference in electric potential level between the DC bias applied to the developer bearing member, and the image portions of the image bearing member. That is, it is the difference in electric potential level between the DC voltage Vdc applied to the development sleeve 41 of the developing apparatus 4, and the electrostatic image (potential level of exposed portions) (FIG. 12). The electrostatic image is developed into an image formed of toner, by the process in which the static electricity, the amount of which corresponds to the amount of development contrast, is cancelled by the electric charge which the numerous toner particles having adhered to the image portions (exposed portions) of the peripheral surface of the photosensitive drum 1.

The control portion 110 (first correcting means) controls the laser light amount control circuit 190, based on the signals from the toner density sensor 14, to adjust the exposing apparatus 3 in the power of its laser, which is used to form an image of the test patch. This control restores to the proper level, the density level at which an image of the test patch is formed when the toner replenishment control is under restriction. Then, the control portion 110 sets the exposing apparatus 3 in the amount of output used for the formation of the ordinary images, based on the amount by which the exposing apparatus 4 was adjusted in the amount of exposure output to form an image of the test patch, which is proper in density. In the comparative example, however, the amount by which the exposing apparatus 3 is adjusted in output when forming an image of the test patch is simply added to (or subtracted from) the output of the exposing apparatus 3, which is used for forming ordinary images.

Referring to FIG. 9(*c*), in an operation in which images which are low in image ratio (low in toner consumption) are continuously formed by a substantial number, the developer in the developing apparatus 4 is continuously stirred while remaining in the developing apparatus 4, and therefore, the toner in the developing apparatus 4 increases in the amount of charge. Consequently, toner is added to the developing apparatus 4 by the patch detection ATR, increasing thereby the developer in the developing apparatus 4 in toner density. However, as the toner density of the developer in the developing apparatus 4 reaches the top limit value (11%) of the proper toner density range, with the timing indicated by an arrow mark in FIG. 9(*b*), the toner replenishment control begins to be restricted, and therefore, the developing apparatus 4 is not going to be replenished with a satisfactory amount of toner.

Referring again to FIG. 9(*b*), as the toner in the developing apparatus 4 increases in the amount of charge because of the restriction placed on the toner replenishment control, the exposure output is increased in steps so that the density level at which an image of the test patch is formed remains at the proper level. Thus, the image forming apparatus 100 increases in development contrast. Therefore, even though the toner in the developing apparatus 4 increases in the amount of charge, the amount by which toner is adhered to an electrostatic image of the test patch remains stable. That is, the image forming apparatus 100 remains stable in the density of an image of the test patch, as shown in FIG. 9(*a*).

Referring also to FIG. 9(*b*), in the case of the comparative example of control, the amount by which the exposing apparatus 3 is adjusted in the exposure output for the test patch image formation is simply added to (or subtracted from) the exposure output for the formation of ordinary images. That is, the amount of change in the development contrast set for the formation of the test patch image, and that for the formation of ordinary images is set to a constant z. In this case, the change in the amount of development contrast for the formation of ordinary image is insufficient, and therefore, the obtained image is insufficient in density.

That is, the development contrast for the formation of ordinary images is greater than the development contrast for the formation of the test patch image. Therefore, if the development bias, and the light for writing an electrostatic image on the photosensitive drum 1, are equally changed in amount, an image of the test patch image will be formed at the proper density level, but ordinary images will be formed at a wrong image density level.

Next, referring to FIG. 10, it is assumed here that because the toner replenishment control is under restriction, the image forming apparatus 100 has become lower in the maximum level of image density than when the toner replenishment control is not under restriction. In this case, as the toner replenishment control begins to be restricted, the image forming apparatus 100 has to be increased in development contrast so that the density level at which it forms images when the toner replenishment control is under restriction matches the image density level at which it forms images when the toner replenishment control is not under restriction. The amount by which the image forming apparatus 100 has to be adjusted in development contrast for the above describe reason is indicated by an arrow mark in the drawing. The exposure output adjustment which uses an image of the test patch can adjust the image forming apparatus 100 in image density level only for the formation of the test patch. Therefore, it can provide only the amount ΔPN, that is, the amount by which the image forming apparatus 100 is to be adjusted in development contrast to yield a test patch image which is proper in density. In other words, it does not provide the amount ΔGN, that is, the amount by which the image forming apparatus 100 is to be adjusted in development contrast to yield ordinary images which are proper in image density. The higher in image density the image to be formed, the greater the amount by which the developing apparatus 100 must be adjust in development contrast. Therefore, if the amount ΔPN is simply used in place of the amount ΔGN, the image forming apparatus 100 is insufficiently controlled.

On the other hand, if the amount ΔPN is used as the amount by which the image forming apparatus 100 is adjusted in development contrast for the formation of ordinary images, when the image forming apparatus 100 has increased in the maximum image density level because of the toner replenishment control is under restriction, the image forming apparatus 100 will yield an image which is improperly higher in density.

Embodiment 1

Figure 11:
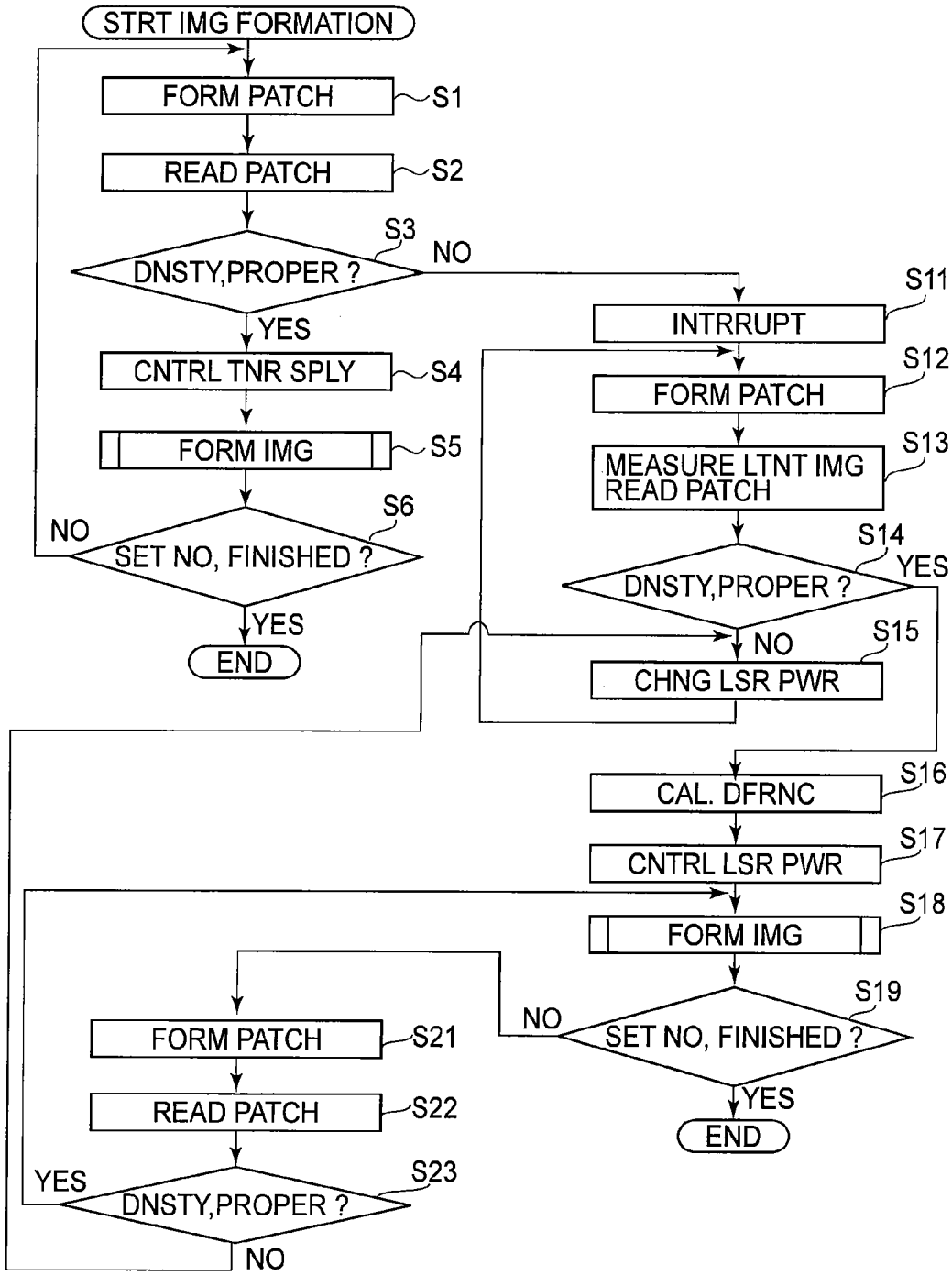
FIG. 11 is a flowchart of the density controlling operation in the first embodiment.
Figure 13:
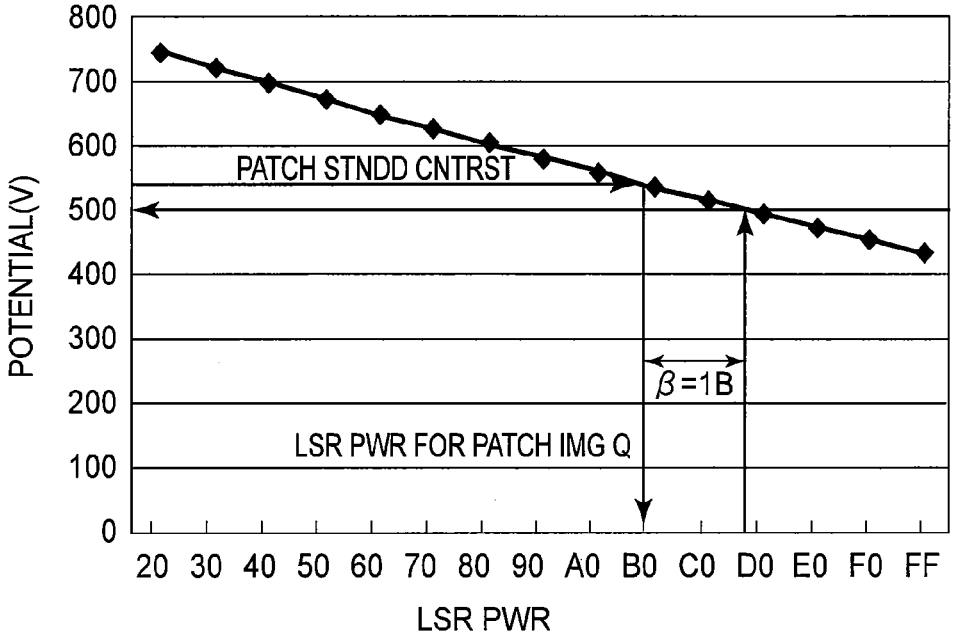
FIG. 13 is a drawing for describing a method for controlling the laser in power to form an electrostatic image of a test patch image, the potential level of which matches a preset level.
Figure 14:
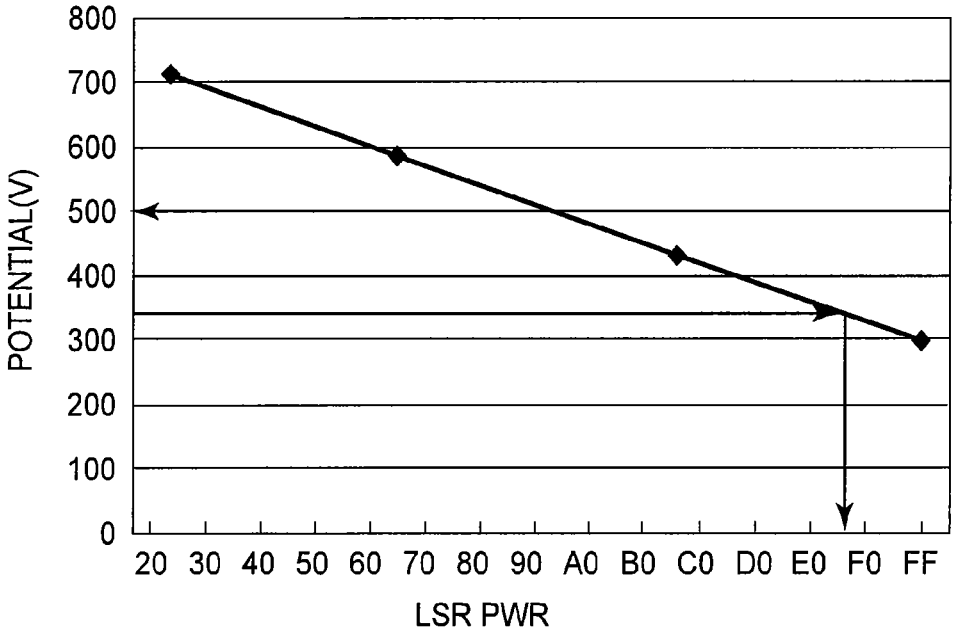
FIG. 14 is a drawing for describing a method for controlling the laser in power to form an electrostatic image of an ordinary normal image.
Figure 15:
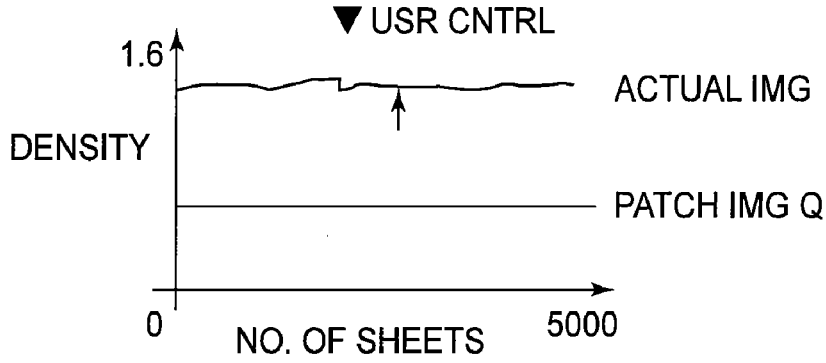
FIG. 15 is a drawing for described the effects of the control in the first embodiment.
Figure 15:
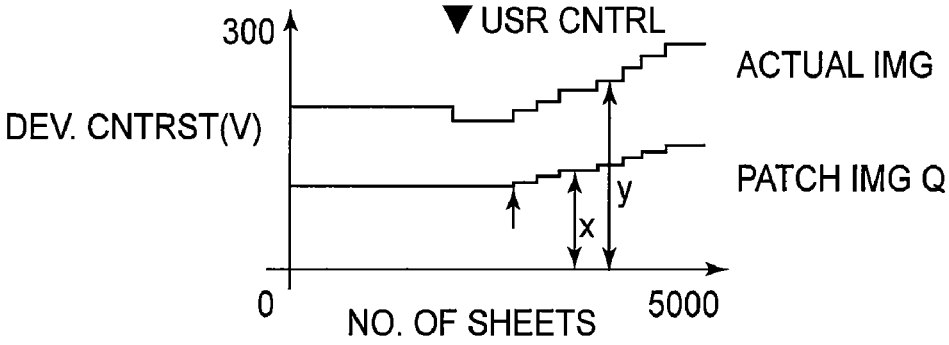
Figure 15:
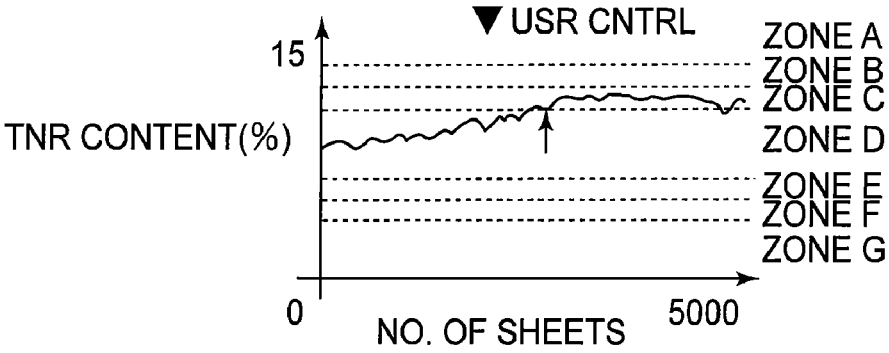

FIG. 11 is a flowchart of the density control in the first embodiment. FIG. 12 is a drawing for describing the development contrast adjustment. FIG. 13 is a drawing for describing the method for controlling the image forming apparatus 100 in the potential level of the electrostatic image of the test patch. FIG. 14 is a drawing for describing the method for controlling the image forming apparatus 100 in the potential level of the electrostatic image of an ordinary image. FIG. 15 is drawing for describing the effects of the image density control in the first embodiment.

Referring to FIG. 11 along with FIG. 4, the control portion 110 forms an image of the test patch Q during one of the image formation intervals in an image forming operation in which a substantial number of images are continuously formed, as shown in FIG. 5 (S1). The amount by which light is reflected by the image of the test patch Q on the photosensitive drum 1 is detected by the image density level sensor 12 (S2).

Next, the control portion 110 detects the toner density level of the developer in the developing apparatus 4 by the toner density level sensor 14. Then, it controls the operation for replenishing the developing apparatus 4 with toner, according to Table 1, based on the detected toner density T/D, basic replenishment amount Mv, and replenishment amount adjustment amount Mp.

TABLE 1

| | Result of ATR (Patch) | | |
|---|---|---|---|
| Toner Densidty | Dark | Proper | Light |
| A (T/D > 13%) | | ATR Error | |
| B (13% ≧ T/D > 12%) | | Stop Supply | |
| C (12% ≧ T/D > 11%) | V. Count ATR only (Ignore patch result) | | |
| D (11% ≧ T/D > 6%) | | Normal Operetion | |

TABLE 1-continued

| Toner Densidty | Result of ATR (Patch) Dark | Proper | Light |
|---|---|---|---|
| E (6% ≧ T/D > 5%) | | | V. Count ATR only (Ignore patch result) |
| D (5% ≧ T/D > 4%) | | Forced Supply | |
| G (4% > T/D) | | ATR Error | |

Referring to Table 1, when the toner density is in zone D, it is proper (YES in S3). Therefore, the control portion 110 simply uses the result of the patch detection ATR to control the amount by which the developing apparatus 4 is replenished with toner using Formula 1 given above (S4), and makes the image forming apparatus 100 to form images (S5), while repeating the steps S1-S6, until images are formed by a number preset by a user (YES in S6).

The toner replenishment amount is set by the toner replenishment control based on the patch detection ATR so that the density signal generated by the image of the test patch Q, shown in FIG. 8, becomes 128 (0.8 in reflection density) in the density range, shown in FIG. 7, which has 255 levels. However, it is possible that the image forming apparatus 100 may change in image properties at any time. Therefore, it cannot be expected that the density level of the image of the test patch Q detected by the image density level sensor 12 is always 128 (0.8 in refection density).

Therefore, the CPU 111 adjusts the toner replenishment amount based on the difference ΔD between the standard density signal generated by the image of the test patch Q and stored in the RAM 112 at the initial setting of the image forming apparatus 100, and the measured density signal level. With this adjustment, the density is made to desirably shift although there will be a certain amount of ripples. That is, the density is very desirably shifted in zone D.

In comparison, in zones A, B, and C, the toner density T/D is no less than 11%. Therefore, even if it is determined, as the result of the patch detection ATR, that the image forming apparatus 100 is low in image density, the control portion 110 restricts the toner replenishment control, because increasing the image forming apparatus 100 (developing apparatus 4) higher than 11% in the toner density T/D may causes the developer to overflow from the developing apparatus 4 and/or causes the image forming apparatus 100 to form foggy images.

That is, if it is determined by the patch detection ATR that the image density is low when the toner density is in zone C, the toner replenishment operation is carried out ignoring the result of the test patch image measurement, that is, based on only the video count ATR (Msum=Mv in Formula 1). When the toner density is in zone B, the toner replenishment operation is carried out regardless of the result of the patch detection ATR. Further, when the toner density is in zone A, the result of the patch detection ATR is deemed as an ATR error regardless of the result of the patch detection ATR, and a message that the toner replenishment control is suffering from problems is given to a user by way of the display 218 of the control panel 20.

On the other hand, when the toner density is in zones E, F, and G, it is no more than 6%. Therefore, even if it is determined by the patch detection ATR that the image density is high when the toner density is in these ranges, the control portion 110 restricts the toner replenishment control, because making the toner density T/D lower than this level makes it possible for the development sleeve 41 to be unsatisfactorily coated with the developer. Thus, the control portion 110 restricts the toner replenishment control.

That is, if it is determined by the patch detection ATR that image density is high, when the toner density is zone E, the result of the measurement of the density of the test patch image is ignored, and the toner replenishment operation is carried out based on only the video count ATR (Msum=Mv in Formula 1). Further, when the toner density is in zone F, the result of the patch detection ATR is ignored, and the developing apparatus 4 is forcefully replenished with a preset amount of toner. Further when the toner density is in zone G, the result of the patch detection ATR is ignored, and an ATR error message is given across the display 218 of the control panel 20 to inform the user that the toner replenishment control has problems.

With the use of this operational procedure, when the toner density is in zones B and C, it does not occur that developer overflows from the developing apparatus 4 (developer container) and/or the image forming apparatus 100 forms foggy images. Further, when the toner density is in zones E and F, the developing apparatus 4 is controlled in the toner density T/D to prevent the development sleeve 41 from being unsatisfactorily coated. Therefore, it does not occur that the toner density falls in zone A, and also, that the image forming apparatus 100 is erroneously stopped by the toner replenishment control.

When the toner density is in zones B, C, E or F (NO in S3), the exposing apparatus 3 is changed in the amount of exposure output to correct the shifting of the image density, by adjusting development contrast (S11-S23). That is, the image forming apparatus 100 is adjusted in the development contrast for the formation of a test patch image, by changing the exposing apparatus 3 in the amount of exposure output while keeping unchanged the potential level to which the image bearing member is charged, and the DC bias applied to the developer bearing member (S12-S15). Then, the image forming apparatus 100 is adjusted in the development contrast for the formation of an ordinary image, by changing the exposing apparatus 3 in the amount of exposure output while keeping unchanged the potential level to which the image bearing member is charged, and the DC bias applied to the developer bearing member, from those used for the formation of the test patch image (S16 and S17).

More specifically, an image forming operation in which a substantial number of images are continuously formed is interrupted (S11), and an image of the test patch is formed (S12). Then, the test patch image is measured in potential level and density (S13). If the density of the test patch image does not equal the standard level (NO in S14), the laser of the exposing apparatus 3 is changed in power (S15). The steps S12-S14 are repeated until the density of the test patch image becomes equal to the standard level. As the density of the test patch image becomes equal to the standard level (YES in S14), the amount by which the image forming apparatus 100 is to be changed in development contrast to form an ordinary image, is obtain by computation, using the development contrast data obtained through the preceding steps, that is, the steps for the formation of a test patch image which is proper in density (S16).

Then, the laser is changed in power for the formation of an ordinary image in proportion to the amount, obtained by the computation, by which the image forming apparatus 100 is to be changed in the development contrast for the formation of an ordinary image (S17), and then, the image forming operation is restarted, and continued (S18) until all the images, the number of which was preset by user, are formed (YES in S19). After the restarting of the image formation, an image of the test patch is formed during one of the intervals between the two images to be consecutively formed (S21), and the density of the formed image of the test patch is measured (S22). If the measured density of the test patch image does not match the standard level (NO in S23), the laser is adjusted again in power based on the result of the measurement of the density of the test patch image (S12-S15).

Next, referring to FIGS. 12(*a*) and 12(*b*), a development contrast VcontP1 for the formation of a test patch image is less than a development contrast VcontG1 for the formation of an ordinary image. In terms of areal gradation, a test patch image is formed at a lower level than an ordinary image; a test patch image is formed with the use of lower exposure power than an ordinary image. This is for making it possible for the image density level sensor 12, shown in FIG. 4, to be enabled to highly precisely detect the image density, as described above with reference to FIG. 7.

In a case where the toner replenishment operation is under restriction, the highest density level of a test patch image and that of an ordinary image shift in the same direction as described above with reference to FIG. 9. However, the amount by which the highest normal image density level changes is greater than the amount by which the highest test patch image level changes. Thus, in a case where toner replenishment operation is under restriction, the amount by which an ordinary image changes in image density can be cancelled by adjusting the development contrast for the formation of an ordinary image by an amount greater than the amount by which the development contrast for the formation of a test patch image is adjusted to cancel the amount by which a test patch image changes in density.

It is possible to directly adjust the image forming apparatus 100 in the development contrast corresponding to the maximum density of an ordinary image, by forming a test patch image under the same condition for forming an ordinary image at the highest density level. This method, however, is inconvenient in that the image density level sensor 12 shown in FIG. 4 cannot highly precisely detect image density; the cleaning apparatus 8 is increased in load; preexisting data and programs for the formation of a test patch image cannot be used; etc.

Therefore, if the output of the density sensor 12 falls outside a preset range, the first adjusting means adjusts the development contrast for the formation of a test patch image so that the density detected by the image density sensor will match the standard level. Then, the second correcting means adjusts the development contrast for the formation of an ordinary image in proportion to the amount by which the development contrast for the formation of a test patch image is adjusted by the first correcting means.

It is assumed here that before and after the correction by the first correcting means, the development contrasts for the formation of a test patch image are VcontP1 and VcontP2, respectively, and that before and after the correction by the second correcting means, the development contrasts for the formation of an ordinary image are VcontG1 and VcontG2, respectively. That is, when the toner replenishment operation is not under restriction, the development contrast for the formation of a test patch image is VcontP1, whereas when the toner replenishment operation is under restriction, the development contrast for the formation of a test patch image is VcontP2. Further, when the toner replenishment operation is not under restriction, the development contrast for the formation of an ordinary image is VcontG1, whereas when the toner replenishment operation is under restriction, the development contrast for the formation of an ordinary image is VcontG2.

The second adjusting means adjusts the development contrast for the formation of an ordinary image VcontG2 so that the VcontG2/VcontG1 becomes proportional to VcontP2/VcontP1. The rational reason for this adjustment is that the relationship between the amount by which the development contrast is to be adjusted and the image density, shown in FIG. 10, is virtually linear.

That is, it is thought that the relationship between development contrast and image density is generally linear as shown in FIG. 10, although it shows a γ characteristic. In particular, in a case where an image forming apparatus is controlled in image density using a test patch of a specific pattern, and areal gradation, the relationship between development contrast and image density tends to become linear, and therefore, the relationship between the amount by which development contrast is to be adjusted, and the amount by which density is to be adjusted, becomes virtually linear.

Thus, even when a test patch image with the highest density cannot be used because of the reason related to the precision in density detection, an amount ΔVcontG by which the development contrast is to be adjusted to adjust the highest density can be accurately estimated, as described above. Even if a test patch image is not formed under the same condition as the condition for the formation of an ordinary image with the highest density, the data necessary for computing the proper amount by which the development contrast VcontG2 for the formation of an ordinary image is to be adjusted can be obtained.

That is, the amount ΔVcontP by which the development contrast for the formation of a test patch image is to be adjusted is obtained through the control for restoring the test patch image density to the standard level. Then, the amount ΔcontG by which the development contrast for the formation of an ordinary image is to be adjusted to adjust the image forming apparatus in the highest density level is obtained from the amount ΔvcontP by which the development contrast for the test patch image formation, using the relationship between the development contrast and image density, which is linear. Thus, the development contrast VcontG2 for the formation of an ordinary image can be properly adjusted.

Referring to FIG. 12(*a*), an electrostatic image of the test patch is formed by lowering the charged portion of the peripheral surface of the photosensitive drum 1 in potential from VD (potential level of unexposed portion) to VLP1 (potential level after exposure) by exposing the charged portion of the peripheral surface of the photosensitive drum 1, when the toner replenishment operation is not under restriction. The development contrast VcontP1 for the formation of the image of a test patch is equal to the deference between the potential level VLP1 of the exposed portion and the potential level of Vdc of the DC voltage applied to the development sleeve 41 (VcontP1=VLP1−Vdc). If the image forming apparatus 100 is reduced in test patch image density because of the restriction upon the toner replenishment control, the apparatus is increased in development contrast to VcontP2 to restore the apparatus in test patch image density.

Incidentally, it is possible to predictively compute the VcontP2 from VcontP1 and the result of the image density measurement, based on the amount by which the image forming apparatus was reduced in the test patch image density. This method, however, reduces the apparatus in the accuracy of the VontP2 by an amount of the error in the prediction. If the VcontP2 is low in accuracy, the ratio between the VontP2 and VontP1 cannot be accurately obtained, and therefore, the development contrast VcontG2 for the formation of an ordinary image is also low in accuracy. Therefore, the first embodiment is preferable in that VontP2 is accurately obtained by measuring image density while actually increasing the development contrast from VcontP1 to VontP2.

Next, referring to FIG. 12(*b*), if the toner replenishment control is not under restriction, an electrostatic image of an ordinary image is formed using an exposure output which is greater than that used for the formation of a test patch image, so that the potential of the exposed point of the peripheral surface of the photosensitive drum 1 reduces to VLG1. There is the following relationship between the development contrast for the formation of an electrostatic image of an ordinary image and the DC voltage Vdc: VcontG1=VLG1−Vdc. If the image forming apparatus is reduced in test patch image density because of the restriction upon the toner replenishment control, the apparatus is increased in the development contrast VcontG to VcontG2 to restore the apparatus in test patch image density. The method for setting the development contrast VcontG2 will be described later.

First, the control portion 110 sets the exposure output of the exposing apparatus 3 (which is first adjusting means) for the formation of a test patch image. It adjusts the development contrast VcontP2 by changing the exposing apparatus 3 in the amount of exposure output for the formation of a test patch image so that the image density of the resultant test patch image will match the standard level, while the toner replenishment control is under restriction. Then, it adjusts the apparatus in the amount of exposure output for the formation of a test patch image, by the amount which is proportional to the measured amount of light reflected by the test patch image. Then, it makes the apparatus to actually form an electrostatic image of the test patch image on the photosensitive drum 1. Then, it detects the potential level VLP2 of an exposed point of the electrostatic image of the test patch, and computes the amount (VcontP2−PcontP1) by which the development contrast for the formation of a test patch image is to be adjusted.

Incidentally, in the first embodiment, the development contrast VcontP2 is adjusted by changing in power the laser of the exposing apparatus 3 for exposing the peripheral surface of the photosensitive drum 1. That is, the development contrast VcontP2 is changed by changing in power the laser of the exposing apparatus 3 so that the level VLP to which the potential of the exposed point is to be reduced changes in value. The charging condition of the charging apparatus 2 and the DC voltage Vdc to be applied to the development sleeve 41 are not changed; only the laser power for the formation of the electrostatic image of a test patch during an interval between the formation of an ordinary image and the formation of the next ordinary image is changed. However, VD (potential of unexposed point) and Vdc (DC voltage applied to development sleeve 41) may be changed as long as the resultant development contrast VconttP2 is the same as that obtained by the above described method.

If the toner replenishment control is not under restriction, the amount of laser power for the formation of a test patch image is determined based on the result of the measurement of the density of the image of the test patch. Referring to FIG. 8, in the patch image potential control, an image having a two line-one space pattern, shown in FIG. 8, is used as a test patch, and exposed (light) point potential VLP is measured by the potential level sensor 5 while changing the laser in power as necessary. In the first embodiment, the patch potential controlling operation is performed as soon as the image forming apparatus 100 is turned on, and for every 5,000th image. With the use of this method, the control portion 110 is enabled to determine the amount of laser power which makes it possible to form an image of the test patch Q, the density of which is equal to the preset target level (VLP1).

Next, referring to FIG. 13, in the patch image potential controlling operation, multiple electrostatic image of the test patch are formed at the same level of areal gradation as that used for the test patch image formation, while changing in steps the exposure output, when the toner replenishment control is not under the restriction. Then, the potential levels of the formed electrostatic images are measured by the potential level detecting means (5). That is, a table for setting the laser power so that the value of the potential of the exposed point becomes equal to the target value is created, by measuring the potential of the electrostatic image of the test patch image while changing in steps the exposing apparatus 3 in laser power. The table is stored in the RAM112. The control portion 110 determines the amount of laser power for the formation of a test patch image using FIG. 13, and the potential level preset for the formation of an electrostatic image of the test patch Q.

The development contrast which makes it possible to form a test patch image, the density of which matches the standard level, when the toner replenishment control is not under restriction, is used as the standard contrast level for a test patch. The control portion 110 sets the laser power based on the development contrast level (VcontP2) for the formation of a test patch image, which is obtained using Formula 4 given below, and Formula 5 given below, and FIG. 13:

Development contrast level for formation of test patch image=Standard development contrast level for formation of test patch image+amount α by which development contrast for formation of test patch image is to be adjusted (Formula 4), Amount of laser power for formation of image of the test patch Q=amount of laser power determined by test patch image potential controlling operation+amount β by which laser power for formation of image of the test patch Q is adjusted (Formula 5).

Then, the control portion 110 makes the image forming apparatus 100 form an image of the test patch, and changes the amount β as shown in Table 2, based on the result of the patch detection ATR performed when the toner replenishment control is under restriction.

TABLE 2

| Detected Patch Density | | |
|---|---|---|
| Light | Proper | Dark |
| β = β + 2 | β = β | β = β − 2 |

Referring to Table 2, if it is determined by the patch detection ATR that the test patch image is lower in density than the standard (referential) level, the control 110 increases the development contrast for the patch image formation by raising two levels the laser power which can be set at any of 256 levels (0-255), to increase the image forming apparatus 100 in patch image density. On the other hand, if it is determined by the patch detection ATR that the patch image is higher in density than the standard (referential) level, the control 110 lowers the image forming apparatus 100 in the development contrast for the formation of a patch image, by lowering the laser power by two levels.

The control portion 110 calculates the development contrast for the patch image formation from the result of the measurement of the electrostatic image of the patch by the potential level sensor 5. Then, it resets the development contrast for the patch image formation, using Table 2, so that the image forming apparatus 100 forms a patch image which is proper in density. The amount of the laser power for the patch image formation is calculated using Formula 5. The result of this calculation is used to calculate the development contrast for the formation of an image of the test patch Q, using the result of the newest patch potential control. The control portion 110 calculates the exposed point potential level VLP2 from the amount of the laser power for the patch image formation, which is calculated using Formula 5, based on the relationship between the laser power and the potential level of the electrostatic image of the patch. Then, it calculates the development contrast level VontP2 for the formation of the image of the test patch, which is the difference between the DC voltage Vdc to be applied to the development sleeve 41 and the exposed point potential level VLP2.

For example, it is assumed that when the development contrast for the formation of a patch image is at the standard level, the exposed point potential level is 530 V, and the laser power set for the patch image formation, through the patch detection ATR is AE, as shown in FIG. 13. It is also assumed that the amount β by which the laser power is adjusted for the patch image formation to cause the patch image density to converge to a proper level is 1B, also as shown in FIG. 13. Then, the laser power C9 for the patch image formation is the sum of AE and 1B (AE+1B=C9). The horizontal axis of FIG. 13 represents the laser power, which is scaled in 256 levels. Each level is written in hexadecimal notation. That is, 255th level is FF in hexadecimal notation.

In this case, the calculated value of the exposed point potential level VLP2 of the electrostatic image of the test patch, which corresponds to laser power C9, is 500V. Assuming that the value of the DC voltage Vdc to be applied to the development sleeve 41 is 600 V (Vdc=600V), the calculated value of the development contrast level VcontP2 for the patch image formation is 100 V (VcontP2=600 V−500 V=100 V)

Then, the control portion 110 calculates the development contrast level VcontG2 for the formation of an ordinary image, using Formula 6, when the toner replenishment control is under restriction:

Development contrast=development contrast for formation of ordinary image×development contrast for formation of patch image/standard development contrast for patch image formation (Formula 6)

Here, the development contrast for the formation of an ordinary image is development contrast level G1, which is proper when the toner density T/D is in zone D and the toner replenishment control is not under restriction. The method for calculating development contrast level VcontG1 will be described later.

In a case where the toner density is in zones B, C, E, and F, and the toner replenishment control is under restriction, it is necessary to properly adjust the image forming apparatus 100 in development contrast in order to stabilize the apparatus 100 in image density. Thus, the development contrast for the formation of an ordinary image is adjusted by the ratio between the development contrast level VcontP2, which makes it possible for the image forming apparatus 100 to form a patch image with the proper density, and the standard development contrast for the formation of the patch image, which is to be used when the toner density T/D is in zone D. That is, the ratio of the change in the developmental properties is calculated from the ratio of the change in the development contrast for the formation of the image of the test patch Q. Then, this ratio is used as the ratio for controlling the development contrast for the formation of an ordinary image to keep the image forming apparatus 100 stable at a proper level in image density.

Then, the control portion 110 calculates the proper amount of laser power to be used for the formation of an ordinary image, and uses the calculated amount of laser power to form images to obtain images which are proper in density.

The amount of laser power for forming images when the toner replenishment control is not under restriction is determined based on the result of the measurement of the density in the image potential controlling process. In the image potential controlling process, an image which is highest in the areal gradation, that is, an image formed by exposing the entire picture elements, is used in place of the image of the test patch Q, the picture elements of which are exposed across every two scan lines with the presence of an interval which is equivalent to a single scan line, and the exposed point potential level VLG is measured by the potential level sensor 5 while changing the laser power as necessary. In the first embodiment, the operation for controlling the potential level for the formation of an ordinary image is carried out following the operation for controlling the potential level for the formation of an image of the test patch. That is, it is performed immediately after the image forming apparatus 100 is turned on, and immediately after the formation of every 5,000th ordinary image. With the use of this control procedure, it is possible for the control portion 110 to determine the amount of laser power that will make the exposed point potential level VLG match the preset target level (VLG1).

Next, referring to FIG. 14 along with FIG. 4, multiple electrostatic images are formed at the highest level of areal gradation, varying in multiple steps the amount of exposure output, one for one, when the toner replenishment control is not under restriction. Then, the multiple electrostatic images are measured in potential level by the potential level detecting means (5). The sole purpose of this operation is to measure the potential levels of the electrostatic images. Therefore, no voltage is applied to the development sleeve 41 to prevent the electrostatic images from being unnecessarily developed. The electrostatic images formed at the highest level in areal gradation while changing the exposing apparatus 3 in the amount of laser power are measured in potential level to create a table for setting the laser power so that the exposed point potential level VLG will match the target level. The thus created table is stored in the RAM 112. The control portion 110 determines the proper amount for the laser power for the formation of an ordinary image, from the development contrast value calculated using Formula 6, and FIG. 14 which shows the relationship between the exposed point potential level VLG and the amount of laser power.

Next, referring to FIG. 12, the control portion 110 uses the relationship between the amount of laser power and potential level shown in FIG. 14, to calculate the amount of laser power to be used, from the exposed point potential level VLG2, which will make the development contrast VcontG become VcontG2 calculated using Formula 6.

In the case of the concrete example described above, the DC voltage Vdc which is to be applied to the development sleeve 41 is 600 V. The standard development contrast for forming an image of the test patch, the density level of which is the standard level, when the toner replenishment control is not under restriction, is 70 V. The standard development contrast for forming a test patch image, the density level of which is the standard level, when the toner replenishment control is under restriction, is 100 V.

In this case, the ratio at which the developmental properties obtainable from the image of the test patch Q is 0.7 (70/100=0.7). Therefore, in order to restore the image forming apparatus 100 in patch image density, the apparatus 100 has to be increased roughly 1.43 times (100/70≈1.43) in development contrast. If the development contrast level VcontG1 for the formation of an ordinary image is 250 V when the toner replenishment control is not under restriction, the development contrast level VcontG2 for the formation of an ordinary image is 286 V (200 V×1.43=286 V). The exposed point potential level VLG2 is 314 V, which is the difference between the DC voltage Vdc (600 V) applied to the development sleeve 41, and the development contrast VcontG2. The amount of the laser power, which makes the exposed point potential level VLG2 314 V is E8 as shown in FIG. 14.

The control portion 110 forms an image by setting the laser power of the exposing apparatus 3 to level E0 (S9). Then, it determines whether or not the preset number of images has been formed (S10). If it determines that the preset number of images have been formed (YES in S10), it ends the image forming operation. If it determines that the preset number of images have not been formed (NO in S10), it repeats the steps S1-S9 in the flowchart.

Next, referring to FIG. 15, an image forming operation in which a substantial number of images are to be continuously formed is performed using the control method in the first embodiment, under the same condition as that under which the same image forming operation is carried out using the comparative control method shown in FIG. 9. More specifically, 5,000 images, which are 5% in image ratio are continuously formed, and the shifting of the density of the patch images and the shifting of the density of the ordinary images are examined. During this operation, the image forming apparatus 100 is adjusted in image density by a user after the formation of every 2,000th image. This adjustment by a user will be described later.

Referring to FIG. 15(*c*), as a substantial number of images which are relative low in image ratio are continuously formed, the developer gradually increased in toner density. After the formation of 2,700th image, the toner density of the developer shifted into zone C in Table 1.

Next, referring to FIG. 15(*b*), after the formation of every 2,700th image, the exposure output for the formation of a test patch image, and the exposure output for the formation of an ordinary image, are raised in steps using the control method in the first embodiment.

Referring to FIG. 15(*a*), the image forming apparatus 100 remained stable in image density as it did when it was controlled by the comparative control method. The changes in the density of an ordinary image (portions with highest in areal gradation) remained in a range of 1.60±0.03, which is very satisfactory.

In the first embodiment, the image forming apparatus is kept stable in the density shift of the patch image at a preset level, by the adjustment of toner density and development contrast. Further, the image forming apparatus 100 is controlled in the development contrast for the formation of an ordinary image so that the ratio between the development contrast for the formation of an image of the test patch Q and the development contrast for the formation of an ordinary image always remains at a preset level. With the use of this control method, the image forming apparatus 100 can be properly adjusted in the development contrast for the formation of an ordinary image, according to the changes in developmental properties. Therefore, the image forming apparatus 100 remains always very desirable in terms of density shift.

<Density Adjustment by User>

Figure 16:
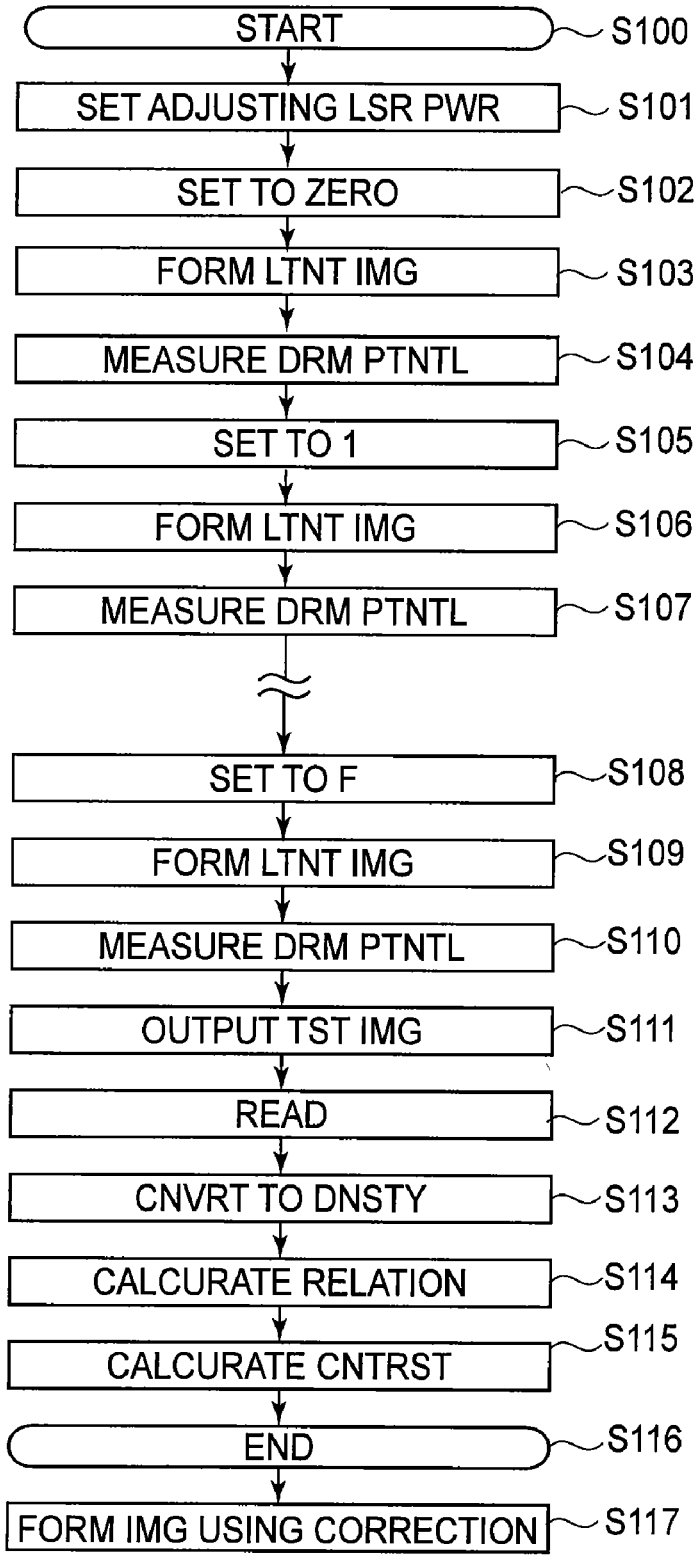
FIG. 16 is a flowchart of a density adjustment operation to be performed by a user.
Figure 17:
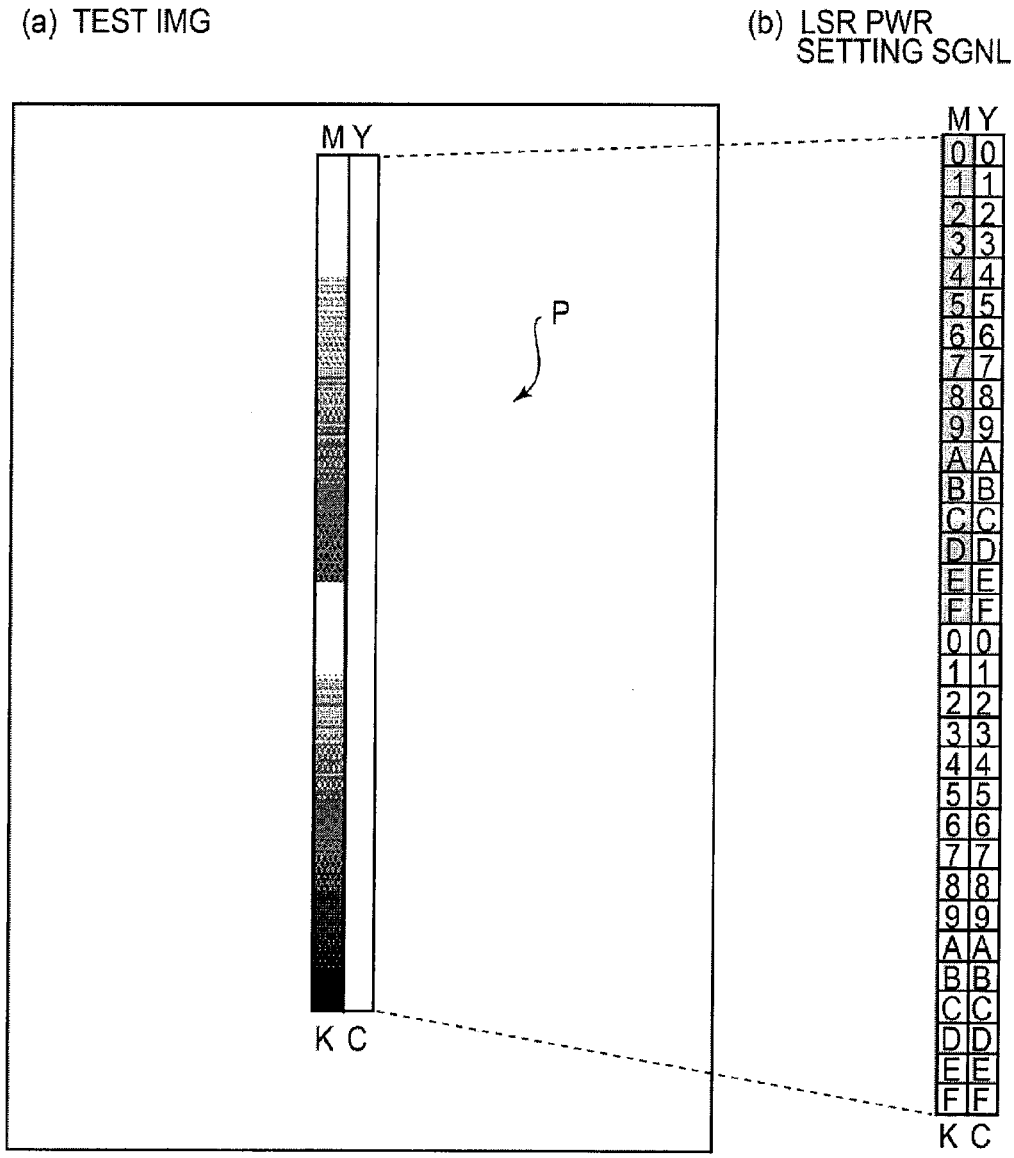
FIG. 17 is a drawing of an image for setting laser power.
Figure 18:
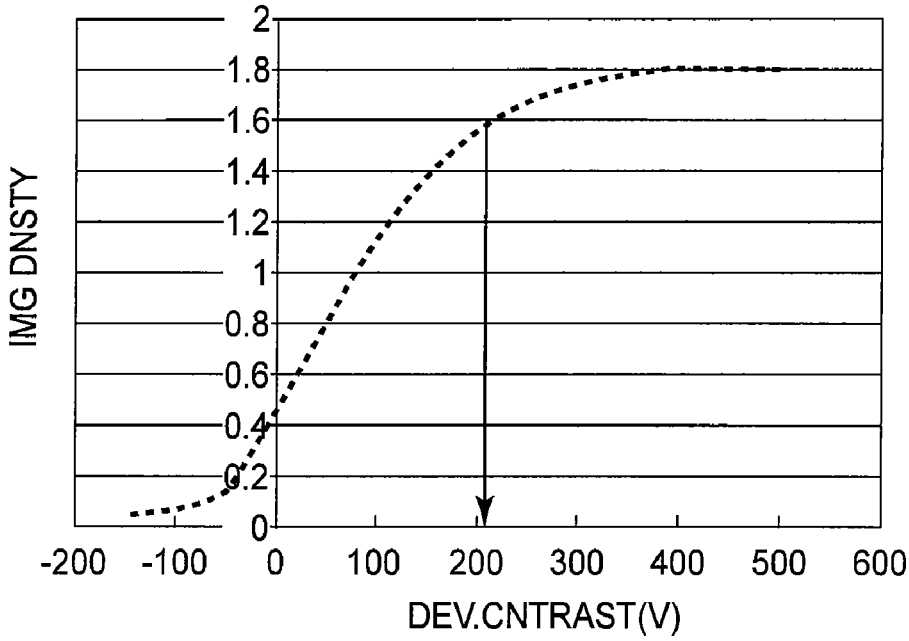
FIG. 18 is a graph which shows the relationship between development contrast and image density.

FIG. 16 is a flowchart of the density adjustment to be made by a user. FIG. 17 is a drawing for describing an image for reading density. FIG. 18 is a drawing for describing the relationship between the development contrast and image density.

In a density adjustment operation to be performed by a user, the development contrast level VontG1 for the formation of an ordinary image, which corresponds to a reflection density of 1.6, is obtained based on the result of the density measurement of the multiple fixed images formed at the highest level in areal gradation, with the exposure output varied in steps.

Also in a density adjustment operation to be performed by a user, the reflection density of a toner image is detected after the transfer of the toner image onto recording medium and the fixation of the toner image. Therefore, the image forming apparatus can be adjusted in density in consideration of its properties regarding transfer and fixation. More specifically, the apparatus is controlled by adjusting it in the ratio between the development contrast level VcontP1 for the formation of an image of the test patch Q and the development contrast level VcontG1 for the formation of an ordinary image, so that when the apparatus is kept stable in the density of the image of the test patch Q at a preset level, the portion of the image, which is highest in areal gradation, becomes 1.6 in reflection density.

A density adjustment operation to be performed by a user is an operation for obtaining the development contrast level VontG1 for the formation of an ordinary image while the toner replenishment control is not under restriction. This density adjustment operation is started by a command from a user, and the development contrast level VcontG1 for the formation of an ordinary image is determined so that the density level at which the image forming apparatus 100 forms images will match the target density level of 1.6.

Referring to FIG. 16 along with FIG. 4, a user is to instruct the image forming apparatus 100 to adjust itself in image density, using the control panel 20 with which the image forming apparatus 100 is provided (S100).

As the density adjustment operation starts, the control portion 110 sets the laser for the density adjustment operation; it sets the laser to a higher power level than the power level for the formation of an ordinary image (S101).

First, the control portion 110 chooses a resolution of 600 dpi, and sets the image signal level to zero (S102). Then, it forms an electrostatic image using exposing apparatus 3 (S103). Then, it measures the exposed point potential VL with the potential level sensor 5 which is next to the peripheral surface of the photosensitive drum 1 (S104).

Then, the control portion 110 sets image signal level to one (S105), and forms an electrostatic image using exposing apparatus 3 (S106). Then, it measures the exposed point potential VL of the photosensitive drum 1 with the potential level sensor 5 (S107).

Then, the control portion 110 increases signal strength by one level, and repeats above described steps. These steps are repeated, while the potential VL of the exposed point is measured by the potential level sensor 5, until the image signal level becomes F (–S110).

For the above described process, the laser power for the exposure is set higher than the laser power range for the formation of an ordinary image, in order to ensure that the images which will be formed after the density adjustment operation will be 1.6 (highest level) in density. In the first embodiment, a value which makes the development contrast for the formation of the electrostatic image higher by 100 V than the development contrast range for the formation of an ordinary image is used as the maximum value for the laser power.

Thereafter, an image of the density measurement scale is formed, transferred onto the recording medium P, fixed to the recording medium P, and outputted (S111).

A user sets the image of the density measurement scale in the image reading apparatus A (reading portion), and inputs a read command through the control panel 20. Thus, the image of the density measurement scale is read by the image reading apparatus A (reader portion) (S112). Then, the control portion 110 detects image density per image signal level from the results of the reading (S113).

Then, the control portion 110 obtains the relationship between the development contrast and image density from the results of the detection of the density of the image of the density level measurement scale, and calculates the relationship between the measured potential level VL of the exposed point of the photosensitive drum 1 and the image density (S114). Then, it calculates the development contrast level which corresponds to the target density level (=1.6) (S115).

The development contrast value obtained through the above described steps is used as the value for the above described development contrast level VontG1 for the formation of an ordinary image, and for the formation of the images thereafter. Therefore, the image forming apparatus 100 can output thereafter images which are highest in areal gradation level and are 1.6 (desired level) in image density.

Incidentally, the development contrast level VcontG1 for the formation of an ordinary image changes only when the image forming apparatus 100 is adjusted in image density by a user. The image forming apparatus 100 can be kept stable at a preset level in image density, by calculating the development contrast level VontG1 necessary when the toner density is in zone D in Table 1, using the development contrast adjustment operation to be carried out by a user, and compensating for the amount of deviation in other zones using the control method in the first embodiment. The image forming apparatus 100 is expected to be stable in the development contrast level VcontG1 for the formation of an ordinary image. However, development contrast is affected also by the properties of the transferring means and/or fixing means. Therefore, the development contrast VcontG1 is adjusted through the density adjustment operation which is performed by a user.

The compensation for the image density deviation attributable to the developing apparatus 4 is made through the toner replenishment control or the contrast voltage adjustment operation in the first embodiment. The ratio between the standard development contrast for the formation of the test patch, and the standard development contrast for the formation of an ordinary image is adjusted through the density adjustment operation which is performed by a user. The ratio between the standard development contrast for the formation of an ordinary image and the actual development contrast for the formation of an ordinary image is calculated from the ratio between the standard contrast for the formation of the image of the test patch Q and the actual development contrast for the formation of the image of the test patch Q.

Incidentally, the density adjustment operation to be performed by a user may be performed when the toner replenishment control is under restriction. If it is performed when the development contrast adjustment operation which uses an image of the test patch Q is being performed, an additional adjustment is made using Formula 7.

Normal development contrast for formation of an ordinary image=development contrast obtained in S115×development contrast for formation of test patch image/standard development contrast for formation of test patch image (Formula 7).

The normal development contrast level VcontG1 for the formation of an ordinary image is calculated in anticipation of a situation in which the compensation will have not been made with the use of the ratio between the actual development contrast for the formation of the test patch image and the standard development contrast for the formation of the test patch image. Then, the value obtained by the calculation is stored in RAM 12.

The development contrast in terms of potential which is used immediately thereafter is: normal development contrast for formation of ordinary image actual development contrast for formation of test patch image/standard development contrast for formation of test patch image. That is, it matches the development contrast level obtained in S115, and therefore, an image, the density level of which matches the target level, or 1.6, can be outputted. Further, when the image forming apparatus 100 is shipped out, it is in the normal condition. Thus, the image of the test patch Q is formed using the standard development contrast level for the patch image formation, and the "density adjustment operation to be performed by a user" is performed by a service person or the like, and the development contrast level obtained by this operation is used as the normal development contrast for the formation of an ordinary image. Also when the image forming apparatus 100 is set at the time of shipment from a factory, the patch potential control operation and image potential level control operation are performed to determine the conditions, in particular, the amount of laser power, under which this development contrast can be realized.

Also in this embodiment, the post-correction development contrast level VcontG2 is determined based on the ratio between the pre- and post-correction development contrast VcontP2/VcontP1, respectively, for the test patch image formation, as shown by Formula 6. However, the post-correction development contrast VcontG2 for the formation of an ordinary image may be set so that it is roughly reversely proportional to the ratio (VcontP2/Vcontp1), that is, the ratio between the pre- and post-correction development contrasts for the formation of the test patch images. Here, "roughly reversely proportional" means the following:

$G2=P2/P1\times G1\times\alpha$ ($\alpha$: proportion coefficient).

It is desired that $\alpha=1$. However, in consideration of the sensitivity of human eyes, the value of $\alpha$ may be in the following range.

Generally, if an amount $\Delta E$ of difference in tone of color is greater than 3 ($\Delta 3>3$), the difference is detectable by human eyes. Therefore, the development contrast has only to be set so that the difference is no greater than 3 ($\Delta E\leqq 3$) after the correction. "$\Delta E=3$" means that the difference is 10% in reflection density relative to the target density level. Further, the difference in potential is roughly reversely proportional to the refection density. Therefore, it is important that the difference in development contrast (difference in potential) is kept within 10% relative to the target potential level.

Thus, it is necessary that the value of $\alpha$ is in a range of 0.9-1.1, preferably, a range of 0.95-1.05 which equals 10%. As described above, in this embodiment, "roughly reversely proportional" means that $\alpha$ (coefficient of proportionality) is within the abovementioned range. That is, the image forming apparatus 100 has only to be set (adjusted in development contrast) so that its development contrast will be within the above-described range after the correction.

Embodiment 2

Figure 19:
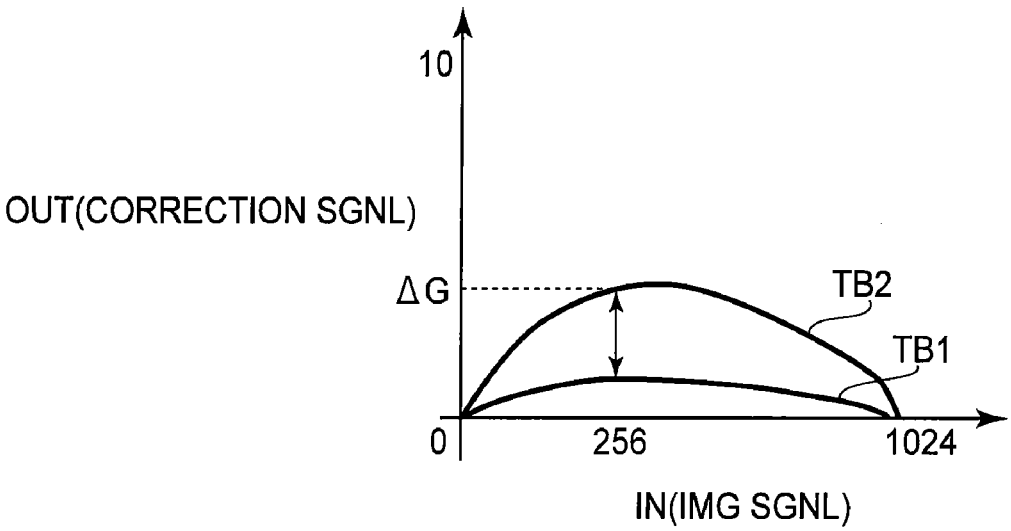
FIG. 19 is a drawing for describing the image data correction table used in the second embodiment.

FIG. 19 is a drawing for describing the table used in the second embodiment to compensate for the image data.

It is assumed here that the image density of an image to be formed is expressed using a density scale having 256 levels (0-255 levels in 8-bit binary notation). In terms of the reproducibility of an image at or near the image density level of 255 (highest level), the image forming apparatus 100 can be made very good by being adjusted in the development contrast for the formation of an ordinary image, using the method in the first embodiment described above. In terms of the reproducibility of an image at or near 0 (lowest level), the image forming apparatus 100 remains very good whether or not it is adjusted in the development contrast for the formation of an ordinary image, using the method in the first embodiment described above. In terms of the reproducibility of an image in the mid range of image density, however, the image forming apparatus 100 slightly fluctuates in performance. Further, the development contrast made proper with the use of the development contrast adjusting method in the first embodiment becomes improper, and therefore, the toner replenishment, exposure output, development contrast, etc., cannot be altered.

In the second embodiment, therefore, an image of a test patch R which is preset in areal gradation is formed using the same amount of exposure output as that obtained in the first embodiment. Then, the image density of the image of the test patch R is measured by the image density level sensor 12. Then, a table for the adjusting the image data in γ is created based on the results of the measurement. Then, the image density in the intermediary gradation range of the image data is corrected into standard density in areal gradation, by correcting in the intermediary gradation range, the image data for forming images when the toner replenishment control is under restriction.

In the second embodiment, the γ-correction table for image data is changed. The amount by which toner was adhered to the toner image formed, with areal gradation set in the intermediary range, using the amount of exposure out set for the formation of an ordinary image by the second correcting means, is detected by the image density level sensor 12. Then, the gamma correction table (γ-correction table) for the exposure image data is adjusted. The density of the image of the test patch R, which is formed using the development contrast which is varied based on the detection of the image of the test patch Q is detected by the image density level sensor 12. Then, the rules for adjusting the input image signal are made based on the results of the detection.

That is, the γ-correction circuit 209 has a LUT (lookup table) to be used for converting image signals into signals having values which agree with the properties of the image forming apparatus 100, in order to enable the image forming apparatus 100 to form images which are desirable in density gradation. The control portion 110 forms at least one image of the test patch R, the density range of which is different from the density range (64 levels) used for forming an image of the test patch Q for the patch detection ATR in the first embodiment. Then, the control portion 110 detects the density of this image of the test patch R with the use of the image density level sensor 12 as in the first embodiment. Then, the control portion 110 controls the γ-correction circuit 209. That is, it forms a new gradation correction LUT (lookup table) for the γ-correction circuit 209 as an image data correcting means, adjusts the current gradation correction table (LUT), or performs the like operations, based on the information obtained by detecting the density of the image of the test patch R, so that the image forming apparatus 100 becomes desirable in gradational properties.

The operation for controlling the γ-correction circuit 209 may be performed each time the image forming apparatus 100 is changed in development contrast (voltage), or with a preset frequency. Further, it may be performed only if the image forming apparatus 100 is changed in development contrast (voltage) by an amount which is no less than a preset value.

The gradation correction table (LUT) for the γ-correction circuit 209 is what defines the rules for correcting the image forming apparatus 100 in the density level at which it outputs images. It shows the relationship between the input signal level and output signal level. The printer control portion 109 generates density level signals for the information of each image, by correcting the inputted image signals using this gradation correction table (LUT), so that the image forming apparatus 100 is enabled to output such images that are idealistically linear in gradation.

The control portion 110 creates a new gradation correction table (LUT) so that the image forming apparatus 100 will be compensated for the deviation in density of the image of the test patch relative to the idealistic density gradation (linear), or corrects the gradation correction table (LUT) in the memory. With the use of the new gradation correction table, or the corrected one, the printer control portion 109 is enabled to generate density level signals for the image information signals, which match the developmental properties of the apparatus 100 at the time of usage and in the place of usage.

Next, the method for adjusting the γ-correction circuit 209 will be described. Referring to FIG. 19 which shows a table TB1 as a control portion reference. An image of the test patch R, the density range (256/1024) of which is different from that of the image of the test patch Q used in the first embodiment, is formed, and the density of this image is detected by the image density level sensor 12. If an amount by which the difference ΔD between the density of the test patch R, which is equivalent to the areal gradation of the test patch R, and the detected density of the actual image of the test patch R, can be cancelled is ΔG, the correction table TB2 is created so that it goes through (256, ΔG). Then, the image signals of an image to be formed are corrected across their entire range. Therefore, it is ensured that the image forming apparatus 100 will be stable in image density across all density range.

Further, a new gradation correction table (LUT) may be created using the following procedure. First, make the image forming apparatus form multiple images of the test patch R, which are different in density range from that in which the images of the test patch Q were formed, and are different in density, and then, measure the densities of the multiple images of the test patch R.

Then, compare the density level of each image of the test patch R with the standard density level of the corresponding referential image. Then, based on the results of the comparison, form such a gradation correction table (LUT) that makes linear the density levels which the image data has before the density correction, and the densities of the outputted images. That is, create a correction table for compensating for the actually measured amount of deviation in density gradation property of the image for density correction. Thereafter, the gradation correction table (LUT) created as described above is used until the next gradation correction table is formed, or it is corrected.

The first and second embodiments are not intended to limit the present invention in scope. The image forming apparatuses (100) in the first and second embodiments was image forming apparatuses of the intermediary transfer type, that is, those which had an intermediary transfer member. However, the present invention is equally applicable also to image forming apparatuses of the direct transfer type, that is, those which have a recording medium bearing member. More specifically, the present invention is applicable also to image forming apparatuses which form monochromatic or multicolor images by forming toner images on a single or multiple image bearing members and transferring the toner images onto recording medium borne on a recording medium conveyance belt.

Further, not only is the present invention applicable, with very good results, to color image forming apparatuses capable of forming full-color images, but also, to image forming apparatuses which form monochromatic images.

In the preceding portions of this specification, an inductance sensor was described as the toner density detecting means for detecting the toner density of developer. However, an optical sensor may be used as the toner density detecting means.

Further, in the first and second embodiments, the image density sensor was used to detect the density of the image of the test patch Q and the density of the image of the test patch R while the images formed on the photosensitive drum were still on the photosensitive drum. However, the density of the image of the test patch Q and the density of the image of the test patch R may be detected by the image density sensor after the transfer of the images formed on the photosensitive drum, onto an intermediary transfer member or a sheet of recording medium on a recording medium bearing member, that is, while the images are on the intermediary transfer member or the sheet of recording medium.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 104720/2009 and 001198/2010 filed Apr. 23, 2009 and Jan. 6, 2010, respectively, which are hereby incorporated by reference.

What is claimed is:

1. An image forming apparatus comprising:

an image bearing member;

a latent image forming device for forming a latent image on said image bearing member in accordance with image information;

a developing device for developing the latent image with a developer, carried on a developer carrying member, including toner and carrier;

a supplying device for supplying the toner to said developing device;

a potential controller for controlling a potential difference between a DC bias voltage applied to the developer carrying member and an image portion potential of said image bearing member, wherein said potential controller controls the potential difference so that the potential difference is smaller in a patch image formation than in a normal image formation;

an image density sensor for detecting an image density of the patch image;

a first controller for correcting an amount of supply from said supplying device on the basis of a detection result of said image density sensor;

a density sensor for detecting a toner content of the developer accommodated in said developing device;

a second controller for limiting the amount of the supply from said supplying device or forcing the supply irrespective of an output of said image density sensor, when an output of said density sensor is outside a predetermined range;

a first correcting device for correcting a development contrast when the patch image is formed when the output of said density sensor is outside the predetermined range; and a second correcting device for correcting a development contrast for the normal image formation in accordance with an amount of correction, by said first correcting device, of the development contrast for a patch image formation, wherein said second correcting device corrects the development contrast for the normal image formation so as to satisfy:

$$VcontG2 = VcontG1 \times VcontP2 / VcontP1 \times \alpha, \text{ and } 0.9 \leqq \alpha \leqq 1.1,$$

where

VcontP1 is the development contrast for the patch image formation before the correction by said first correcting device, VcontP2 is the development contrast for the patch image formation after the correction by said first correcting device, VcontG1 is the development contrast for the normal image formation before the correction by said second correcting device, and VcontG2 is the development contrast for the normal image formation after the correction by said second correcting device.

2. An apparatus according to claim 1, wherein $\alpha$ satisfies $0.95 \leqq \alpha \leqq 1.05$.

3. An apparatus according to claim 1, wherein the patch image is formed for each predetermined number of image formations of continuous image formations, wherein said first correcting device corrects the development contrast for the patch image formation by changing an exposure output with the image portion potential of said image bearing member while the DC bias applied to the developer carrying member remains unchanged, and wherein said second correcting device corrects the development contrast for the normal image formation by changing the exposure output with the image portion potential of said image bearing member while the DC bias applied to the developer carrying member is the same as the DC bias applied for the patch image formation.

4. An apparatus according to claim 3, wherein a gamma correction table for adjusting exposure image data is created on the basis of a patch image measurement and is changed on the basis of a result of detection of the patch image by said image density sensor, the patch image being formed using the exposure output corrected by said second correcting device.

5. An apparatus according to claim 1, wherein said second correcting device corrects the development contrast for the normal image formation so that VcontG2/VcontG1 is proportional to VcontP2/VcontP1.

* * * * *